US009889670B1

(12) United States Patent
Komplin et al.

(10) Patent No.: US 9,889,670 B1
(45) Date of Patent: Feb. 13, 2018

(54) FLUIDIC DISPENSING DEVICE

(71) Applicant: FUNAI ELECTRIC CO., LTD., Osaka (JP)

(72) Inventors: Steven R. Komplin, Lexington, KY (US); James D. Anderson, Jr., Harrodsburg, KY (US)

(73) Assignee: FUNAI ELECTRIC CO., LTD. (JP)

( * ) Notice: Subject to any disclaimer, the term of this patent is extended or adjusted under 35 U.S.C. 154(b) by 0 days.

(21) Appl. No.: 15/373,684

(22) Filed: Dec. 9, 2016

(51) Int. Cl.
*B41J 2/175* (2006.01)

(52) U.S. Cl.
CPC ..... *B41J 2/17513* (2013.01); *B41J 2/175* (2013.01); *B41J 2/17503* (2013.01); *B41J 2/17553* (2013.01); *B41J 2/17596* (2013.01)

(58) Field of Classification Search
CPC .... B41J 2/175; B41J 2/17503; B41J 2/17513; B41J 2/17553; B41J 2/17596
See application file for complete search history.

(56) References Cited

U.S. PATENT DOCUMENTS 5,153,612 A * 10/1992 Dunn ..... B41J 2/17513 347/87
5,198,156 A 3/1993 Middleton et al.
6,332,676 B1 12/2001 Santhanam
6,969,164 B2 11/2005 Kerr et al.
7,172,272 B2 2/2007 Tsuchiya et al.
7,182,444 B2 2/2007 Kawamoto
7,618,133 B2 11/2009 Kubo et al.
7,894,023 B2 2/2011 Ando et al.
8,608,300 B2 12/2013 Igawa et al.
2001/0013886 A1 8/2001 Underwood et al.
2001/0015742 A1 8/2001 Childers
2001/0024225 A1 9/2001 Ishizawa et al.
2001/0030675 A1 10/2001 Kobayashi et al.
2002/0012026 A1 1/2002 Kubota et al.
2002/0089576 A1 7/2002 Ishizawa et al.
2002/0109760 A1 8/2002 Miyazawa et al.
2002/0154570 A1 10/2002 Gebrian
2002/0167555 A1 11/2002 Miura et al.
2003/0042274 A1 3/2003 Johanson
2003/0072216 A1 4/2003 Araki
2003/0107950 A1 6/2003 Shepherd et al.
2004/0051766 A1 3/2004 Miyazawa et al.
2004/0095842 A1 5/2004 Weetman
2004/0104984 A1 6/2004 Hall et al.
2005/0046682 A1 3/2005 Kawamoto
2005/0093211 A1 5/2005 Shiraishi et al.
(Continued)

*Primary Examiner* — Geoffrey Mruk
(74) *Attorney, Agent, or Firm* — Aust IP Law

(57) ABSTRACT

A fluidic dispensing device has a body that includes a base wall having an exterior base surface, and an interior perimetrical wall that extends from the base wall to define a chamber. The interior perimetrical wall has a perimetrical end surface. The body has an exterior wall extending away from the base wall. The exterior wall has a chip mounting surface defining a first plane, the base wall being oriented along a second plane, the first plane being orthogonal to the second plane. An ejection chip is mounted to the chip mounting surface of the body. A diaphragm is engaged with the perimetrical end surface of the chamber to define a fluid reservoir. A lid is attached to the body, with the diaphragm interposed between the lid and the body. The body and the lid define a split at a juncture of the lid and the body.

20 Claims, 18 Drawing Sheets

(56) References Cited

U.S. PATENT DOCUMENTS

| | | | |
|---|---|---|---|
| 2005/0248634 | A1 | 11/2005 | Aruga |
| 2006/0071989 | A1 | 4/2006 | Lewey et al. |
| 2006/0268080 | A1 | 11/2006 | Nakazawa |
| 2006/0290753 | A1 | 12/2006 | Tatsumi et al. |
| 2007/0019047 | A1 | 1/2007 | Kleinert et al. |
| 2007/0052771 | A1 | 3/2007 | Inoue et al. |
| 2007/0052773 | A1 | 3/2007 | Kawamura et al. |
| 2007/0165485 | A1 | 7/2007 | Cai |
| 2007/0188563 | A1 | 8/2007 | Takahashi |
| 2007/0242114 | A1 | 10/2007 | Kubota et al. |
| 2008/0031088 | A1 | 2/2008 | Ukita |
| 2008/0165233 | A1 | 7/2008 | Lin et al. |
| 2008/0186368 | A1 | 8/2008 | Silverbrook et al. |
| 2009/0033725 | A1 | 2/2009 | Toba et al. |
| 2009/0079802 | A1 | 3/2009 | Ito |
| 2009/0122121 | A1 | 5/2009 | Kawasaki et al. |
| 2009/0189931 | A1 | 7/2009 | Noro et al. |
| 2009/0213159 | A1 | 8/2009 | Aoki et al. |
| 2009/0251517 | A1 | 10/2009 | Matsumoto |
| 2009/0289976 | A1 | 11/2009 | Nishimura |
| 2009/0322840 | A1 | 12/2009 | Wanibe |
| 2010/0103233 | A1 | 4/2010 | Akatsuka et al. |
| 2011/0280098 | A1 | 11/2011 | Shiono |
| 2012/0000645 | A1 | 1/2012 | Willimczik |
| 2012/0056948 | A1 | 3/2012 | Kim et al. |
| 2012/0062523 | A1 | 3/2012 | Park et al. |
| 2012/0075364 | A1 | 3/2012 | Nakazawa |
| 2012/0105555 | A1 | 5/2012 | Mcfarland et al. |
| 2012/0140003 | A1 | 6/2012 | Szusdziara et al. |
| 2012/0200645 | A1 | 8/2012 | Okina |
| 2012/0200649 | A1 | 8/2012 | Igawa et al. |
| 2013/0342618 | A1 | 12/2013 | Frasure et al. |
| 2014/0061961 | A1 | 3/2014 | Ishizawa et al. |
| 2014/0098146 | A1 | 4/2014 | Kamiyama |
| 2015/0165399 | A1 | 6/2015 | Rawlings |

* cited by examiner

FLUIDIC DISPENSING DEVICE

CROSS-REFERENCE TO RELATED APPLICATIONS

This application is related to U.S. patent application Ser. No. 15/183,666, now U.S. Pat. No. 9,744,771; Ser. No. 15/183,693, now U.S. Pat. No. 9,707,767; Ser. No. 15/183,705, now U.S. Pat. No. 9,751,315; Ser. No. 15/183,722, now U.S. Pat. No. 9,751,316; Ser. Nos. 15/183,736; 15/193,476; 15/216,104; 15/239,113; 15/256,065, now U.S. Pat. No. 9,688,074; Ser. Nos. 15/278,369; 15/373,123; 15/373,243; 15/373,635; and Ser. No. 15/435,983.

BACKGROUND OF THE INVENTION

1. Field of the Invention

The present invention relates to fluidic dispensing devices, and, more particularly, to a fluidic dispensing device, such as a microfluidic dispensing device, having a lid-body split design.

2. Description of the Related Art

One type of microfluidic dispensing device, such as an ink jet printhead, is designed to include a capillary member, such as foam or felt, to control backpressure. In this type of printhead, the only free fluid is present between a filter and the ejection device. If settling or separation of the fluid occurs, it is almost impossible to re-mix the fluid contained in the capillary member.

Another type of printhead is referred to in the art as a free fluid style printhead, which has a movable wall that is spring loaded to maintain backpressure at the nozzles of the printhead. One type of spring loaded movable wall uses a deformable deflection bladder to create the spring and wall in a single piece. An early printhead design by Hewlett-Packard Company used a circular/cylindrical deformable rubber part in the form of a thimble shaped bladder positioned between a container lid and a body. The thimble shaped bladder maintained backpressure in the ink enclosure defined by the thimble shaped bladder by deforming the bladder material as ink was delivered to the printhead chip. More particularly, in this design, the body is relatively planar, and a printhead chip is attached to an exterior of the relatively planar body on an opposite side of the body from the thimble shaped bladder. The thimble shaped bladder is an elongate cylindrical-like structure having a distal sealing rim that engages the planar body to form the ink enclosure. Thus, in this design, the sealing rim of the thimble shaped bladder is parallel to the printhead chip. A central longitudinal axis of the container lid and thimble shaped bladder extends though the location of the printhead chip and the corresponding chip pocket of the body. The deflection of the thimble shaped bladder collapses on itself, i.e., around and inwardly toward the central longitudinal axis.

What is needed in the art is a fluidic dispensing device having a lid-body split design that has a fluid chamber defined by an interior perimetrical wall of a body and has a diaphragm that engages an end surface of the interior perimetrical wall of the body.

SUMMARY OF THE INVENTION

The present invention provides a fluidic dispensing device having a lid-body split design that has a fluid chamber defined by an interior perimetrical wall of a body and has a diaphragm that engages an end surface of the interior perimetrical wall of the body.

The invention in one form is directed to a fluidic dispensing device having a body that includes a base wall having an exterior base surface, and an interior perimetrical wall that extends from the base wall to define a chamber. The interior perimetrical wall has a perimetrical end surface. The body has an exterior wall extending away from the base wall. The exterior wall has a chip mounting surface defining a first plane, the base wall being oriented along a second plane, the first plane being orthogonal to the second plane. An ejection chip is mounted to the chip mounting surface of the body. A diaphragm is engaged with the perimetrical end surface of the chamber to define a fluid reservoir. A lid is attached to the body, with the diaphragm interposed between the lid and the body. The body and the lid define a split at a juncture of the lid and the body.

In one implementation, a ratio of a distance A from the exterior base surface of the base wall of the body to a center of the ejection chip and a distance C from the exterior base surface of the base wall of the body to a top of the exterior wall of the body at the location of the split is in a range of 20 percent to 80 percent, and the distance A is less than the distance C.

The invention in another form is directed to a fluidic dispensing device having a body that includes a base wall having an exterior base surface, and an interior perimetrical wall that extends from the base wall to define a chamber. The interior perimetrical wall has a perimetrical end surface. The body has an exterior wall extending away from the base wall. The exterior wall has a chip mounting surface defining a first plane. The base wall is oriented along a second plane. The first plane is orthogonal to the second plane. An ejection chip is mounted to the chip mounting surface of the body. A diaphragm is engaged with the perimetrical end surface of the chamber to define a fluid reservoir. The diaphragm has a dome portion. A lid is attached to the body, with the diaphragm interposed between the lid and the body. The lid has a lid portion that accommodates the dome portion of the diaphragm. The body and the lid define a split at a juncture of the lid and the body. A ratio of a distance A from the exterior base surface of the base wall of the body to a center of the ejection chip and a distance B from the exterior base surface of the base wall of the body to the perimetrical end surface of the interior perimetrical wall of the chamber of the body is in a range of 20 percent to 80 percent, and the distance A is less than the distance B.

The invention in another form is directed to a fluidic dispensing device having a body including a base wall having an exterior base surface, and an interior perimetrical wall that extends from the base wall to define a chamber. The interior perimetrical wall has a perimetrical end surface. The body has an exterior wall extending away from the base wall. The exterior wall has a chip mounting surface defining a first plane. The base wall is oriented along a second plane, with the first plane being orthogonal to the second plane. An ejection chip is mounted to the chip mounting surface of the body. A diaphragm is engaged with the perimetrical end surface of the chamber to define a fluid reservoir. The diaphragm has a dome portion. A lid is attached to the body, with the diaphragm interposed between the lid and the body. The lid has a lid portion that accommodates the dome portion of the diaphragm. The body and the lid define a split at a juncture of the lid and the body. A ratio of the distance B from the exterior base surface of the base wall of the body to the perimetrical end surface of the interior perimetrical wall of the chamber of the body and a distance D from the exterior base surface of the base wall of the body to a top of the lid portion of the lid that accommodates the dome portion of the diaphragm is in a range of 40 percent to 95 percent, and the distance B is less than the distance D.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
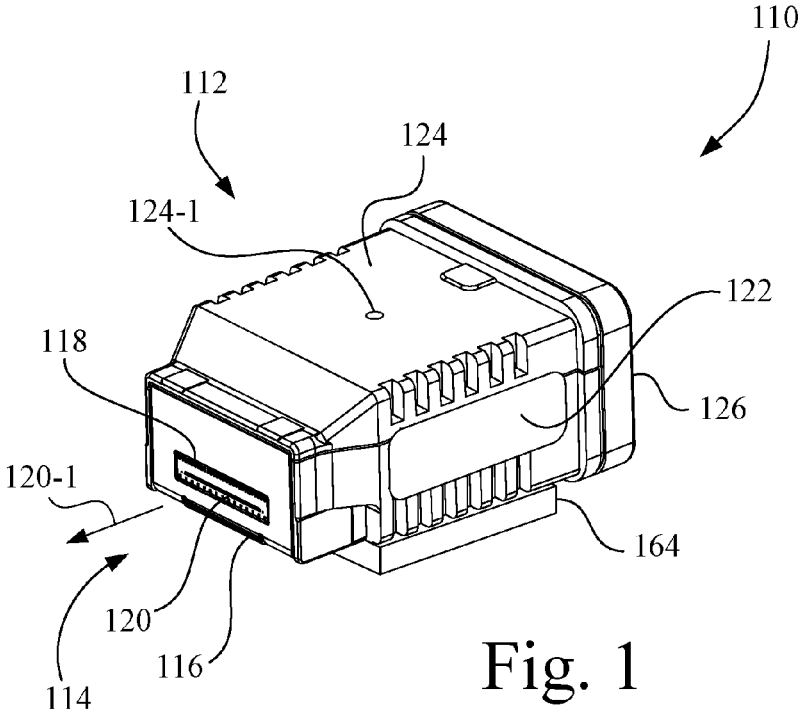
FIG. 1 is a perspective view of an embodiment of a microfluidic dispensing device in accordance with the present invention, in an environment that includes an external magnetic field generator.
Figure 2:
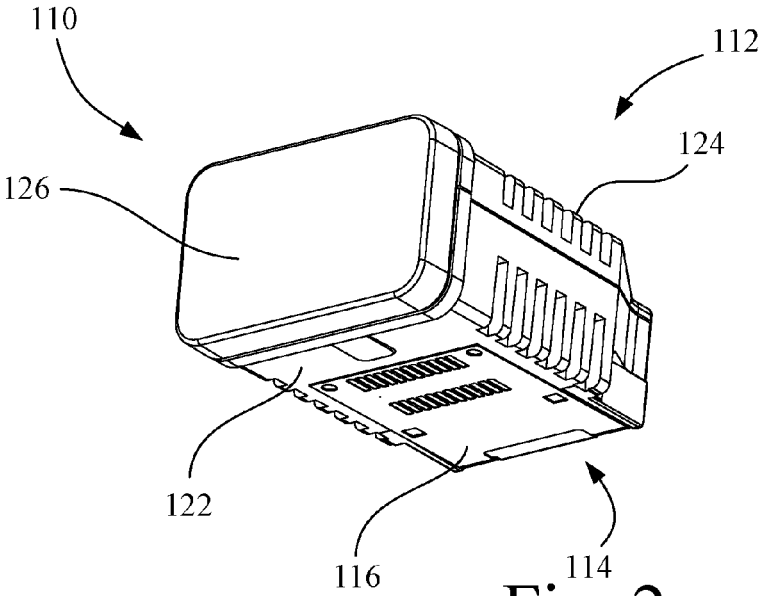
FIG. 2 is another perspective view of the microfluidic dispensing device of FIG. 1.
Figure 3:
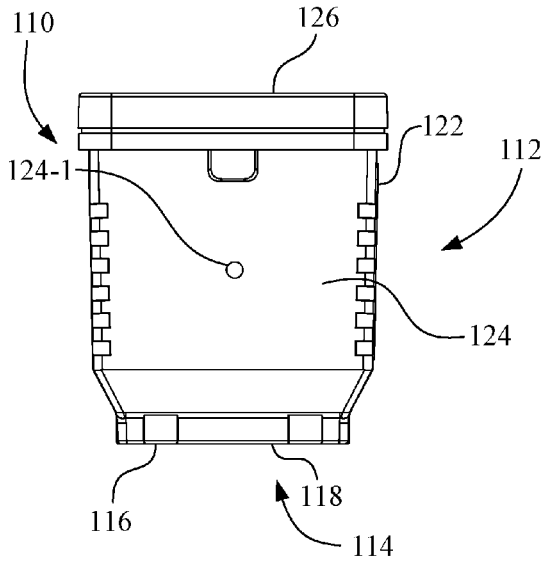
FIG. 3 is a top orthogonal view of the microfluidic dispensing device of FIGS. 1 and 2.
Figure 4:
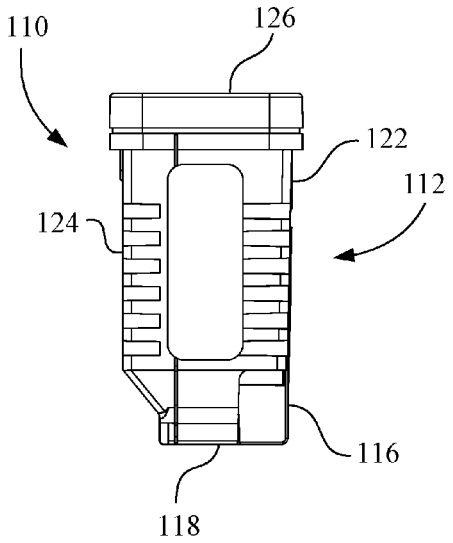
FIG. 4 is a side orthogonal view of the microfluidic dispensing device of FIGS. 1 and 2.
Figure 5:
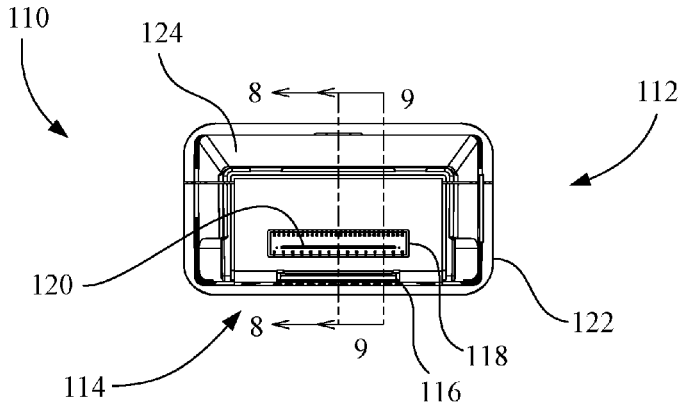
FIG. 5 is an end orthogonal view of the microfluidic dispensing device of FIGS. 1 and 2.

Referring now to the drawings, and more particularly to FIGS. 1-16, there is shown a fluidic dispensing device, which in the present example is a microfluidic dispensing device 110 in accordance with an embodiment of the present invention.

Referring to FIGS. 1-5, microfluidic dispensing device 110 generally includes a housing 112 and a tape automated bonding (TAB) circuit 114. Microfluidic dispensing device 110 is configured to contain a supply of a fluid, such as a fluid containing particulate material, and TAB circuit 114 is configured to facilitate the ejection of the fluid from housing 112. The fluid may be, for example, cosmetics, lubricants, paint, ink, etc.

Figure 6:
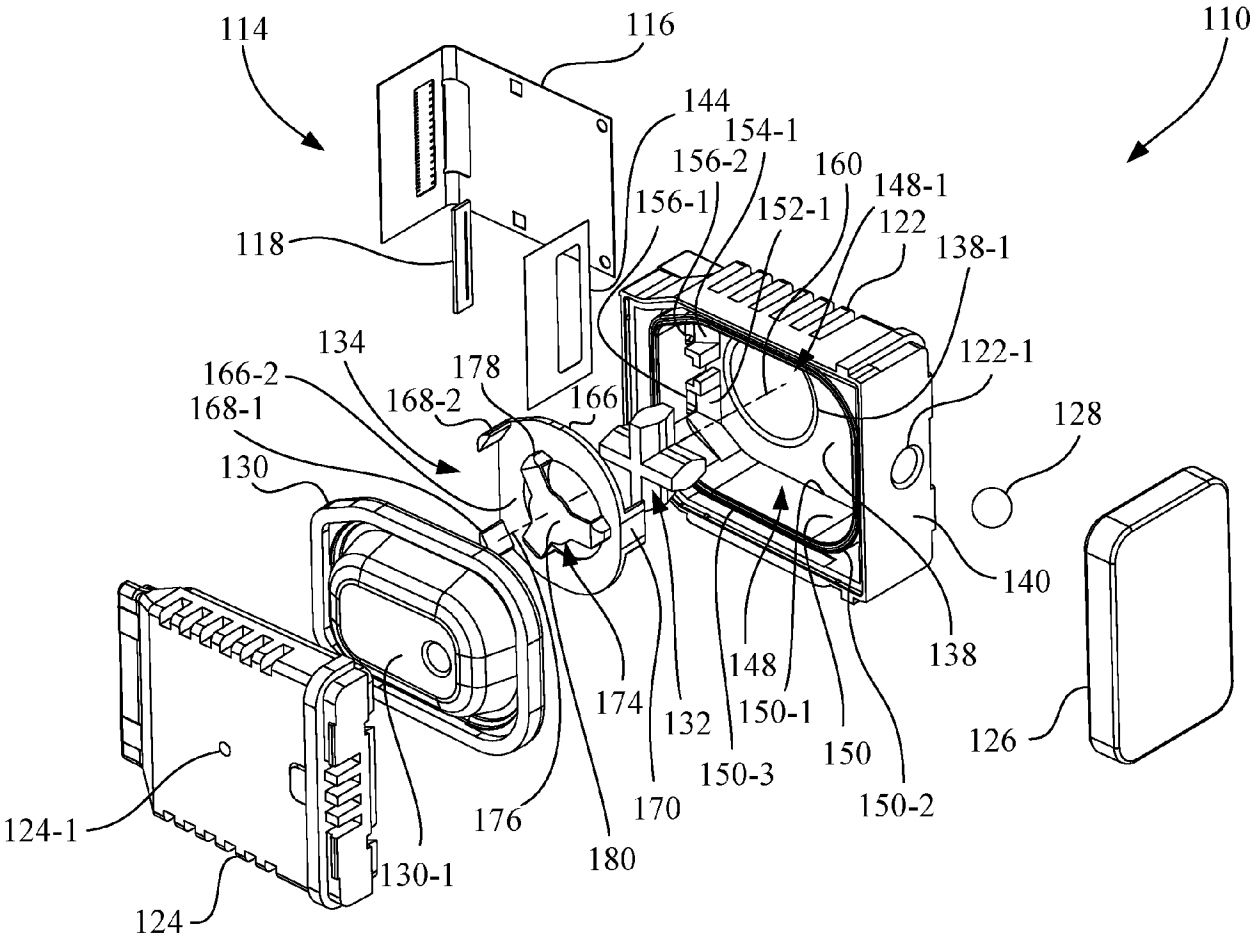
FIG. 6 is an exploded perspective view of the microfluidic dispensing device of FIGS. 1 and 2, oriented for viewing into the chamber of the body in a direction toward the ejection chip.
Figure 7:
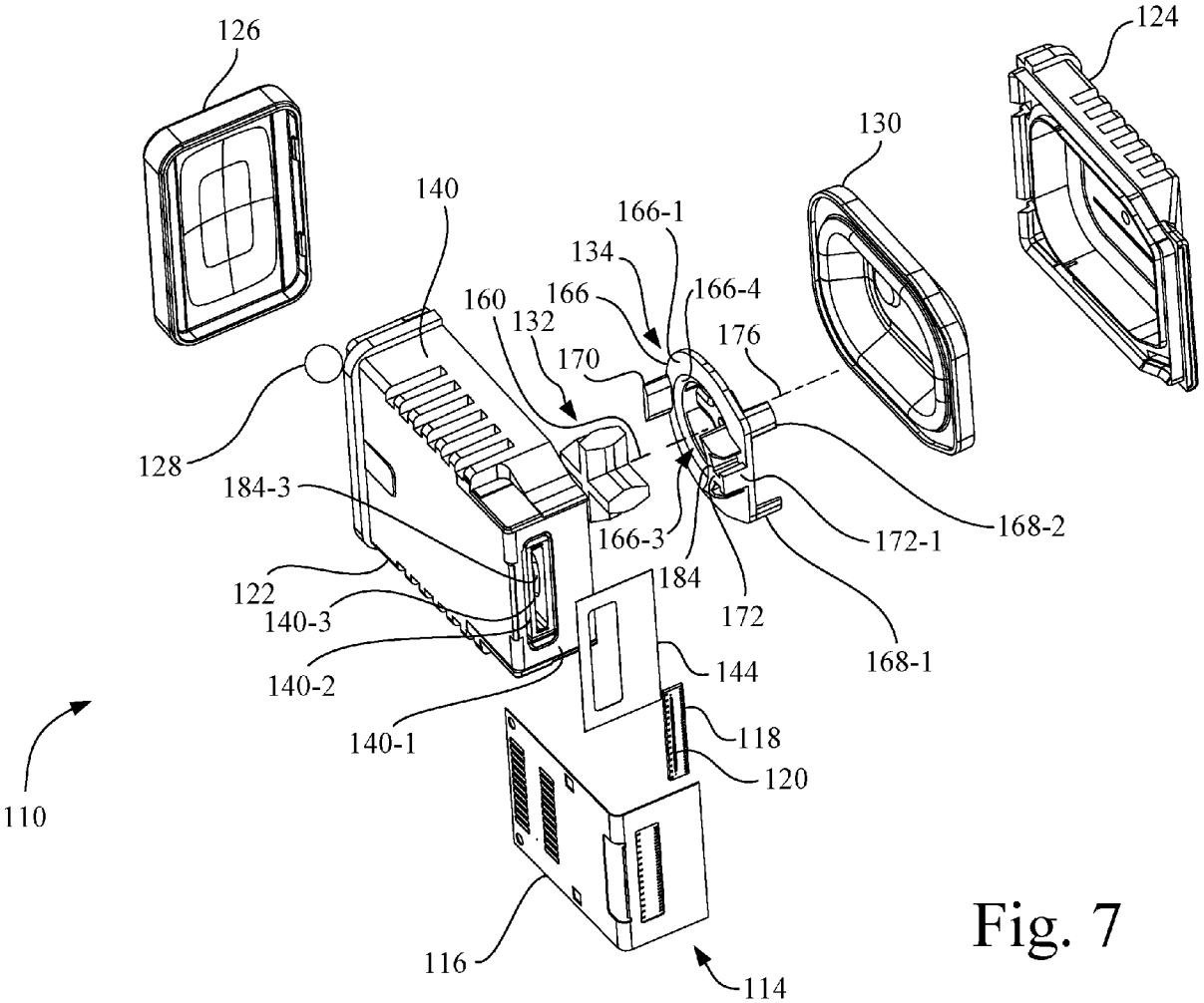
FIG. 7 is another exploded perspective view of the microfluidic dispensing device of FIGS. 1 and 2, oriented for viewing in a direction away from the ejection chip.

Referring also to FIGS. 6 and 7, TAB circuit 114 includes a flex circuit 116 to which an ejection chip 118 is mechanically and electrically connected. Flex circuit 116 provides electrical connection to an electrical driver device (not shown), such as an ink jet printer, configured to operate ejection chip 118 to eject the fluid that is contained within housing 112. In the present embodiment, ejection chip 118 is configured as a plate-like structure having a planar extent formed generally as a nozzle plate layer and a silicon layer, as is well known in the art. The nozzle plate layer of ejection chip 118 has a plurality of ejection nozzles 120 oriented such that a fluid ejection direction 120-1 is substantially orthogonal to the planar extent of ejection chip 118. Associated with each of the ejection nozzles 120, at the silicon layer of ejection chip 118, is an ejection mechanism, such as an electrical heater (thermal) or piezoelectric (electromechanical) device. The operation of such an ejection chip 118 and driver is well known in the micro-fluid ejection arts, such as in ink jet printing.

As used herein, each of the terms substantially orthogonal and substantially perpendicular is defined to mean an angular relationship between two elements of 90 degrees, plus or minus 10 degrees. The term substantially parallel is defined to mean an angular relationship between two elements of zero degrees, plus or minus 10 degrees.

As best shown in FIGS. 6 and 7, housing 112 includes a body 122, a lid 124, an end cap 126, and a fill plug 128 (e.g., ball). Contained within housing 112 is a diaphragm 130, a stir bar 132, and a guide portion 134. Each of the housing 112 components, stir bar 132, and guide portion 134 may be made of plastic, using a molding process. Diaphragm 130 is made of elastomeric material, such as rubber or a thermoplastic elastomer (TPE), using an appropriate molding process. Also, in the present embodiment, fill plug 128 may be in the form of a stainless steel ball bearing.

Figure 8:
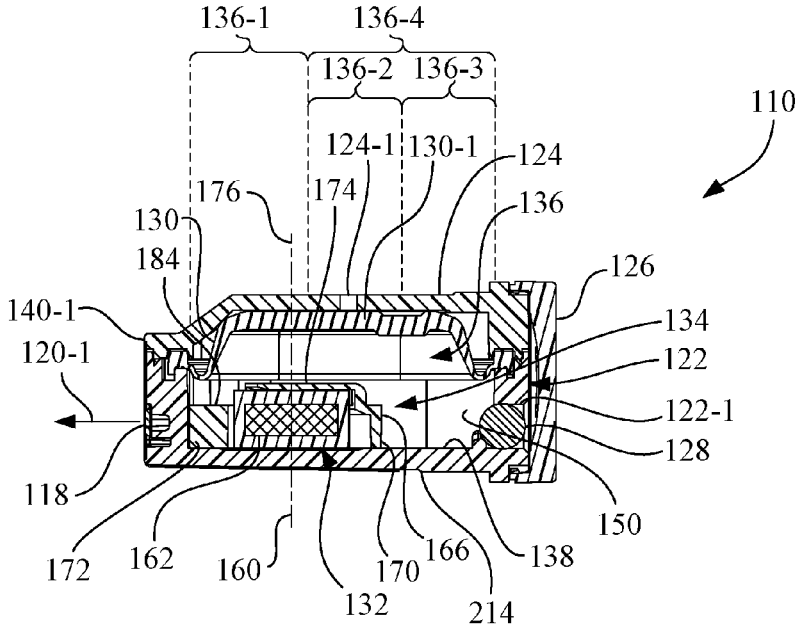
FIG. 8 is a section view of the microfluidic dispensing device of FIG. 1, taken along line 8-8 of FIG. 5.
Figure 9:
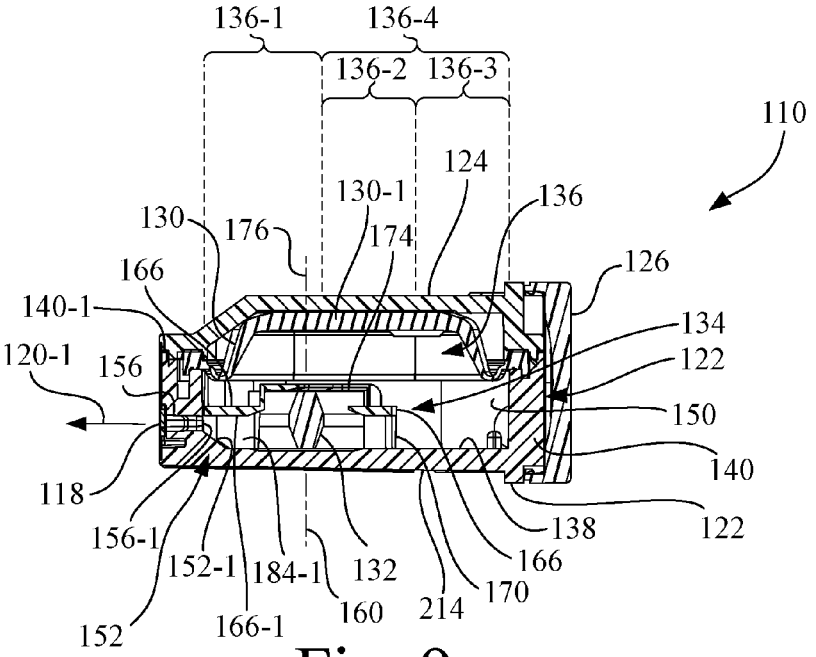
FIG. 9 is a section view of the microfluidic dispensing device of FIG. 1, taken along line 9-9 of FIG. 5.

Referring also to FIGS. 8 and 9, in general, a fluid (not shown) is loaded through a fill hole 122-1 in body 122 (see also FIG. 6) into a sealed region, i.e., a fluid reservoir 136, between body 122 and diaphragm 130. Back pressure in fluid reservoir 136 is set and then maintained by inserting, e.g., pressing, fill plug 128 into fill hole 122-1 to prevent air from leaking into fluid reservoir 136 or fluid from leaking out of fluid reservoir 136. End cap 126 is then placed onto an end of the body 122/lid 124 combination, opposite to ejection chip 118. Stir bar 132 resides in the sealed fluid reservoir 136 between body 122 and diaphragm 130 that contains the fluid. An internal fluid flow may be generated within fluid reservoir 136 by rotating stir bar 132 so as to provide fluid mixing and redistribution of particulate in the fluid within the sealed region of fluid reservoir 136.

Referring now also to FIGS. 10-16, body 122 of housing 112 has a base wall 138 and an exterior perimeter wall 140 contiguous with base wall 138. Exterior perimeter wall 140 is oriented to extend from base wall 138 in a direction that is substantially orthogonal to base wall 138. Lid 124 is configured to engage exterior perimeter wall 140. Thus, exterior perimeter wall 140 is interposed between base wall 138 and lid 124, with lid 124 being attached to the open free end of exterior perimeter wall 140 by weld, adhesive, or other fastening mechanism, such as a snap fit or threaded union. Attachment of lid 124 to body 122 occurs after installation of diaphragm 130, stir bar 132, and guide portion 134 in body 122.

Figure 16:
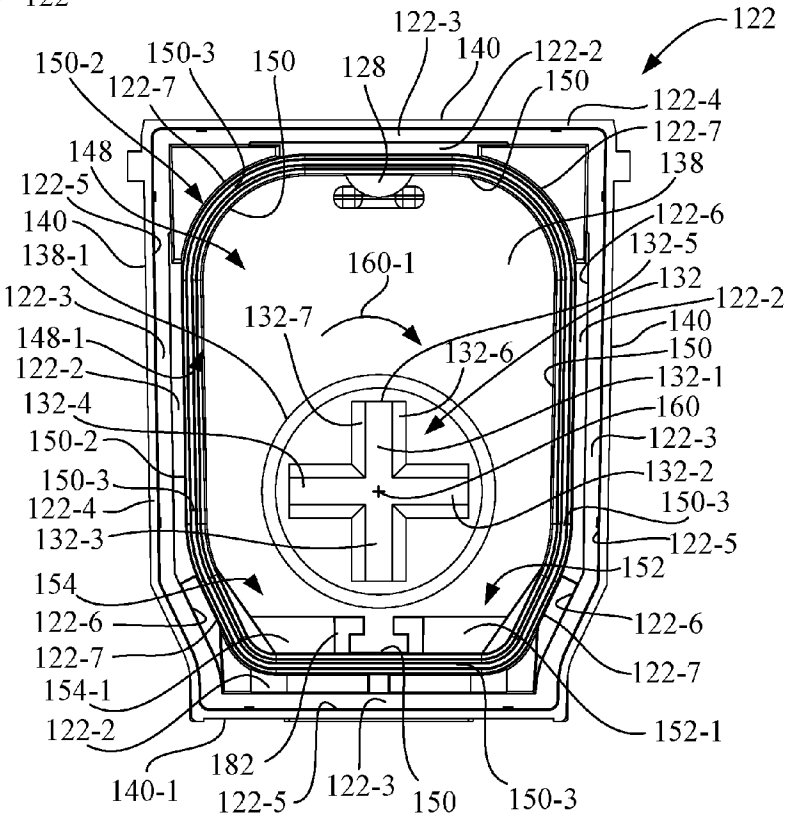
FIG. 16 is an enlarged view of the depiction of FIG. 12, with the guide portion removed to expose the stir bar residing in the chamber of the body.
Figure 15:
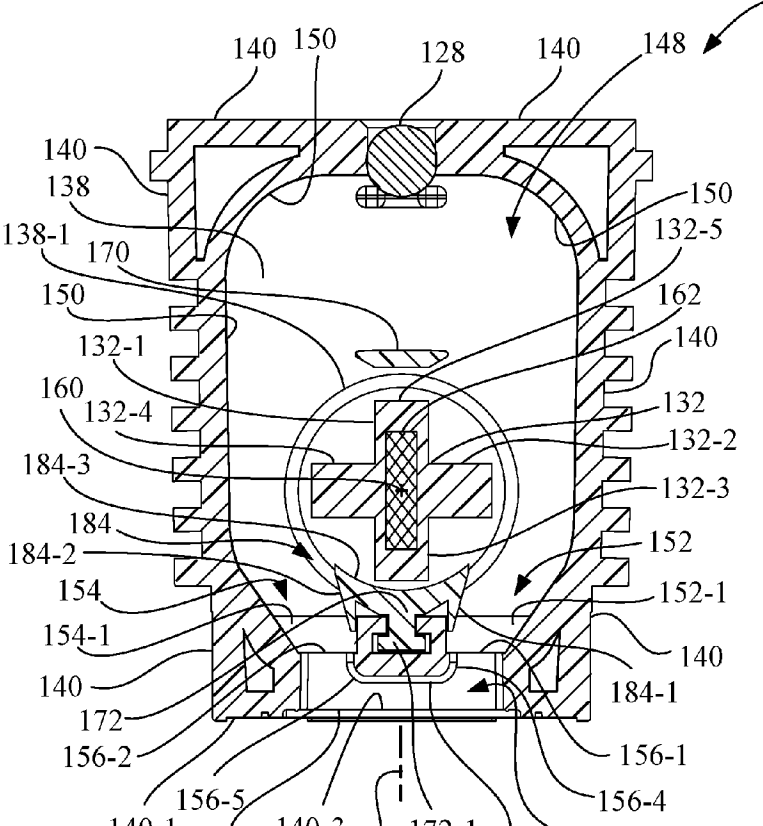
FIG. 15 is an enlarged section view of the body/guide portion/stir bar arrangement of FIGS. 12 and 13, taken along line 15-15 of FIG. 13.

Exterior perimeter wall 140 of body 122 includes an exterior wall 140-1, which is a contiguous portion of exterior perimeter wall 140. Exterior wall 140-1 has a chip mounting surface 140-2 that defines a plane 142 (see FIGS. 11 and 12), and has a fluid opening 140-3 adjacent to chip mounting surface 140-2 that passes through the thickness of exterior wall 140-1. Ejection chip 118 is mounted, e.g., by an adhesive sealing strip 144 (see FIGS. 6 and 7), to chip mounting surface 140-2 and is in fluid communication with fluid opening 140-3 (see FIG. 13) of exterior wall 140-1. Thus, the planar extent of ejection chip 118 is oriented along plane 142, with the plurality of ejection nozzles 120 oriented such that the fluid ejection direction 120-1 is substantially orthogonal to plane 142. Base wall 138 is oriented along a plane 146 (see FIG. 11) that is substantially orthogonal to plane 142 of exterior wall 140-1. As best shown in FIGS. 6, 15 and 16, base wall 138 may include a circular recessed region 138-1 in the vicinity of the desired location of stir bar 132.

Referring to FIGS. 11-16, body 122 of housing 112 also includes a chamber 148 located within a boundary defined by exterior perimeter wall 140. Chamber 148 forms a portion of fluid reservoir 136, and is configured to define an interior space, and in particular, includes base wall 138 and has an interior perimetrical wall 150 configured to have rounded corners, so as to promote fluid flow in chamber 148. Interior perimetrical wall 150 of chamber 148 has an extent bounded by a proximal end 150-1 and a distal end 150-2. Proximal end 150-1 is contiguous with, and may form a transition radius with, base wall 138. Such an edge radius may help in mixing effectiveness by reducing the number of sharp corners. Distal end 150-2 is configured to define a perimetrical end surface 150-3 at a lateral opening 148-1 of chamber 148. Perimetrical end surface 150-3 may include a single perimetrical rib, or a plurality of perimetrical ribs or undulations as shown, to provide an effective sealing surface for engagement with diaphragm 130. The extent of interior perimetrical wall 150 of chamber 148 is substantially orthogonal to base wall 138, and is substantially parallel to the corresponding extent of exterior perimeter wall 140 (see FIG. 6).

As best shown in FIGS. 15 and 16, chamber 148 has an inlet fluid port 152 and an outlet fluid port 154, each of which is formed in a portion of interior perimetrical wall 150. The terms "inlet" and "outlet" are terms of convenience that are used in distinguishing between the multiple ports of the present embodiment, and are correlated with a particular rotational direction of stir bar 132. However, it is to be understood that it is the rotational direction of stir bar 132 that dictates whether a particular port functions as an inlet port or an outlet port, and it is within the scope of this invention to reverse the rotational direction of stir bar 132, and thus reverse the roles of the respective ports within chamber 148.

Inlet fluid port 152 is separated a distance from outlet fluid port 154 along a portion of interior perimetrical wall 150. As best shown in FIGS. 15 and 16, considered together, body 122 of housing 112 includes a fluid channel 156 interposed between the portion of interior perimetrical wall 150 of chamber 148 and exterior wall 140-1 of exterior perimeter wall 140 that carries ejection chip 118.

Fluid channel 156 is configured to minimize particulate settling in a region of ejection chip 118. Fluid channel 156 is sized, e.g., using empirical data, to provide a desired flow rate while also maintaining an acceptable fluid velocity for fluid mixing through fluid channel 156.

In the present embodiment, referring to FIG. 15, fluid channel 156 is configured as a U-shaped elongated passage having a channel inlet 156-1 and a channel outlet 156-2. Fluid channel 156 dimensions, e.g., height and width, and shape are selected to provide a desired combination of fluid flow and fluid velocity for facilitating intra-channel stirring.

Fluid channel 156 is configured to connect inlet fluid port 152 of chamber 148 in fluid communication with outlet fluid port 154 of chamber 148, and also connects fluid opening 140-3 of exterior wall 140-1 of exterior perimeter wall 140 in fluid communication with both inlet fluid port 152 and outlet fluid port 154 of chamber 148. In particular, channel inlet 156-1 of fluid channel 156 is located adjacent to inlet fluid port 152 of chamber 148 and channel outlet 156-2 of fluid channel 156 is located adjacent to outlet fluid port 154 of chamber 148. In the present embodiment, the structure of inlet fluid port 152 and outlet fluid port 154 of chamber 148 is symmetrical.

Fluid channel 156 has a convexly arcuate wall 156-3 that is positioned between channel inlet 156-1 and channel outlet 156-2, with fluid channel 156 being symmetrical about a channel mid-point 158. In turn, convexly arcuate wall 156-3 of fluid channel 156 is positioned between inlet fluid port 152 and outlet fluid port 154 of chamber 148 on the opposite side of interior perimetrical wall 150 from the interior space of chamber 148, with convexly arcuate wall 156-3 positioned to face fluid opening 140-3 of exterior wall 140-1 and ejection chip 118.

Convexly arcuate wall 156-3 is configured to create a fluid flow through fluid channel 156 that is substantially parallel to ejection chip 118. In the present embodiment, a longitudinal extent of convexly arcuate wall 156-3 has a radius that faces fluid opening 140-3 and that is substantially parallel to ejection chip 118, and has transition radii 156-4, 156-5 located adjacent to channel inlet 156-1 and channel outlet 156-2, respectively. The radius and transition radii 156-4, 156-5 of convexly arcuate wall 156-3 help with fluid flow efficiency. A distance between convexly arcuate wall 156-3 and fluid ejection chip 118 is narrowest at the channel mid-point 158, which coincides with a mid-point of the longitudinal extent of ejection chip 118, and in turn, with a mid-point of the longitudinal extent of fluid opening 140-3 of exterior wall 140-1.

Each of inlet fluid port 152 and outlet fluid port 154 of chamber 148 has a beveled ramp structure configured such that each of inlet fluid port 152 and outlet fluid port 154 converges in a respective direction toward fluid channel 156. In particular, inlet fluid port 152 of chamber 148 has a beveled inlet ramp 152-1 configured such that inlet fluid port 152 converges, i.e., narrows, in a direction toward channel inlet 156-1 of fluid channel 156, and outlet fluid port 154 of chamber 148 has a beveled outlet ramp 154-1 that diverges, i.e., widens, in a direction away from channel outlet 156-2 of fluid channel 156.

Referring again to FIGS. 6-10, diaphragm 130 is positioned between lid 124 and perimetrical end surface 150-3 of interior perimetrical wall 150 of chamber 148. The attachment of lid 124 to body 122 compresses a perimeter of diaphragm 130 thereby creating a continuous seal between diaphragm 130 and body 122. More particularly, diaphragm 130 is configured for sealing engagement with perimetrical end surface 150-3 of interior perimetrical wall 150 of chamber 148 in forming fluid reservoir 136. Thus, in combination, chamber 148 and diaphragm 130 cooperate to define fluid reservoir 136 having a variable volume.

Referring particularly to FIGS. 6, 8 and 9, an exterior surface of diaphragm 130 is vented to the atmosphere external to microfluidic dispensing device 110 through a vent hole 124-1 located in lid 124 so that a controlled negative pressure can be maintained in fluid reservoir 136. Diaphragm 130 is made of elastomeric material, and includes a dome portion 130-1 configured to progressively collapse toward base wall 138 as fluid is depleted from microfluidic dispensing device 110, so as to maintain a desired negative pressure (i.e., backpressure) in chamber 148, and thus changing the effective volume of the variable volume of fluid reservoir 136. As used herein, the term "collapse" means to fall in, as to buckle, sag, or deflect.

Referring to FIGS. 8 and 9, for sake of further explanation, below, the variable volume of fluid reservoir 136, also referred to herein as a bulk region, may be considered to have a proximal continuous ⅓ volume portion 136-1, and a continuous ⅔ volume portion 136-4 that is formed from a central continuous ⅓ volume portion 136-2 and a distal continuous ⅓ volume portion 136-3, with the central continuous ⅓ volume portion 136-2 separating the proximal continuous ⅓ volume portion 136-1 from the distal continuous ⅓ volume portion 136-3. The proximal continuous ⅓ volume portion 136-1 is located closer to ejection chip 118 than the continuous ⅔ volume portion 136-4 that is formed from the central continuous ⅓ volume portion 136-2 and the distal continuous ⅓ volume portion 136-3.

Referring to FIGS. 6-9 and 16, stir bar 132 resides in the variable volume of fluid reservoir 136 and chamber 148, and is located within a boundary defined by the interior perimetrical wall 150 of chamber 148. Stir bar 132 has a rotational axis 160 and a plurality of paddles 132-1, 132-2, 132-3, 132-4 that radially extend away from the rotational axis 160. Stir bar 132 has a magnet 162 (see FIG. 8), e.g., a permanent magnet, configured for interaction with an external magnetic field generator 164 (see FIG. 1) to drive stir bar 132 to rotate around the rotational axis 160. The principle of stir bar 132 operation is that as magnet 162 is aligned to a strong enough external magnetic field generated by external magnetic field generator 164, then rotating the external magnetic field generated by external magnetic field generator 164 in a controlled manner will rotate stir bar 132. The external magnetic field generated by external magnetic field generator 164 may be rotated electronically, akin to operation of a stepper motor, or may be rotated via a rotating shaft. Thus, stir bar 132 is effective to provide fluid mixing in fluid reservoir 136 by the rotation of stir bar 132 around the rotational axis 160.

Fluid mixing in the bulk region relies on a flow velocity caused by rotation of stir bar 132 to create a shear stress at the settled boundary layer of the particulate. When the shear stress is greater than the critical shear stress (empirically determined) to start particle movement, remixing occurs because the settled particles are now distributed in the moving fluid. The shear stress is dependent on both the fluid parameters such as: viscosity, particle size, and density; and mechanical design factors such as: container shape, stir bar 132 geometry, fluid thickness between moving and stationary surfaces, and rotational speed.

Also, a fluid flow is generated by rotating stir bar 132 in a fluid region, e.g., the proximal continuous ⅓ volume portion 136-1 and fluid channel 156, associated with ejection chip 118, so as to ensure that mixed bulk fluid is presented to ejection chip 118 for nozzle ejection and to move fluid adjacent to ejection chip 118 to the bulk region of fluid reservoir 136 to ensure that the channel fluid flowing through fluid channel 156 mixes with the bulk fluid of fluid reservoir 136, so as to produce a more uniform mixture. Although this flow is primarily distribution in nature, some mixing will occur if the flow velocity is sufficient to create a shear stress above the critical value.

Stir bar 132 primarily causes rotation flow of the fluid about a central region associated with the rotational axis 160 of stir bar 132, with some axial flow with a central return path as in a partial toroidal flow pattern.

Referring to FIG. 16, each paddle of the plurality of paddles 132-1, 132-2, 132-3, 132-4 of stir bar 132 has a respective free end tip 132-5. To reduce rotational drag, each paddle may include upper and lower symmetrical pairs of chamfered surfaces, forming leading beveled surfaces 132-6 and trailing beveled surfaces 132-7 relative to a rotational direction 160-1 of stir bar 132. It is also contemplated that each of the plurality of paddles 132-1, 132-2, 132-3, 132-4 of stir bar 132 may have a pill or cylindrical shape. In the present embodiment, stir bar 132 has two pairs of diametrically opposed paddles, wherein a first paddle of the diametrically opposed paddles has a first free end tip 132-5 and a second paddle of the diametrically opposed paddles has a second free end tip 132-5.

In the present embodiment, the four paddles forming the two pairs of diametrically opposed paddles are equally spaced at 90 degree increments around the rotational axis 160. However, the actual number of paddles of stir bar 132 may be two or more, and preferably three or four, but more preferably four, with each adjacent pair of paddles having the same angular spacing around the rotational axis 160. For example, a stir bar 132 configuration having three paddles may have a paddle spacing of 120 degrees, having four paddles may have a paddle spacing of 90 degrees, etc.

In the present embodiment, and with the variable volume of fluid reservoir 136 being divided as the proximal continuous ⅓ volume portion 136-1 and the continuous ⅔ volume portion 136-4 described above, with the proximal continuous ⅓ volume portion 136-1 being located closer to ejection chip 118 than the continuous ⅔ volume portion 136-4, the rotational axis 160 of stir bar 132 may be located in the proximal continuous ⅓ volume portion 136-1 that is closer to ejection chip 118. Stated differently, guide portion 134 is configured to position the rotational axis 160 of stir bar 132 in a portion of the interior space of chamber 148 that constitutes a ⅓ of the volume of the interior space of chamber 148 that is closest to fluid opening 140-3.

Referring again also to FIG. 11, the rotational axis 160 of stir bar 132 may be oriented in an angular range of perpendicular, plus or minus 45 degrees, relative to the fluid ejection direction 120-1. Stated differently, the rotational axis 160 of stir bar 132 may be oriented in an angular range of parallel, plus or minus 45 degrees, relative to the planar extent (e.g., plane 142) of ejection chip 118. In combination, the rotational axis 160 of stir bar 132 may be oriented in both an angular range of perpendicular, plus or minus 45 degrees, relative to the fluid ejection direction 120-1, and an angular range of parallel, plus or minus 45 degrees, relative to the planar extent of ejection chip 118.

More preferably, the rotational axis 160 has an orientation substantially perpendicular to the fluid ejection direction 120-1, and thus, the rotational axis 160 of stir bar 132 has an orientation that is substantially parallel to plane 142, i.e., planar extent, of ejection chip 118 and that is substantially perpendicular to plane 146 of base wall 138. Also, in the present embodiment, the rotational axis 160 of stir bar 132 has an orientation that is substantially perpendicular to plane 146 of base wall 138 in all orientations around rotational axis 160 and is substantially perpendicular to the fluid ejection direction 120-1.

Referring to FIGS. 6-9, 11, and 12, the orientations of stir bar 132, described above, may be achieved by guide portion 134, with guide portion 134 also being located within chamber 148 in the variable volume of fluid reservoir 136 (see FIGS. 8 and 9), and more particularly, within the boundary defined by interior perimetrical wall 150 of chamber 148. Guide portion 134 is configured to confine stir bar 132 in a predetermined portion of the interior space of chamber 148 at a predefined orientation, as well as to split and redirect the rotational fluid flow from stir bar 132 towards channel inlet 156-1 of fluid channel 156. On the return flow side, guide portion 134 helps to recombine the rotational flow received from channel outlet 156-2 of fluid channel 156 in the bulk region of fluid reservoir 136.

For example, guide portion 134 may be configured to position the rotational axis 160 of stir bar 132 in an angular range of parallel, plus or minus 45 degrees, relative to the planar extent of ejection chip 118, and more preferably, guide portion 134 is configured to position the rotational axis 160 of stir bar 132 substantially parallel to the planar extent of ejection chip 118. In the present embodiment, guide portion 134 is configured to position and maintain an orientation of the rotational axis 160 of stir bar 132 to be substantially parallel to the planar extent of ejection chip 118 and to be substantially perpendicular to plane 146 of base wall 138 in all orientations around rotational axis 160.

Guide portion 134 includes an annular member 166, a plurality of locating features 168-1, 168-2, offset members 170, 172, and a cage structure 174. The plurality of locating features 168-1, 168-2 are positioned on the opposite side of annular member 166 from offset members 170, 172, and are positioned to be engaged by diaphragm 130, which keeps offset members 170, 172 in contact with base wall 138. Offset members 170, 172 maintain an axial position (relative to the rotational axis 160 of stir bar 132) of guide portion 134 in fluid reservoir 136. Offset member 172 includes a retention feature 172-1 that engages body 122 to prevent a lateral translation of guide portion 134 in fluid reservoir 136.

Referring again to FIGS. 6 and 7, annular member 166 of guide portion 134 has a first annular surface 166-1, a second annular surface 166-2, and an opening 166-3 that defines an annular confining surface 166-4. Opening 166-3 of annular member 166 has a central axis 176. Annular confining surface 166-4 is configured to limit radial movement of stir bar 132 relative to the central axis 176. Second annular surface 166-2 is opposite first annular surface 166-1, with first annular surface 166-1 being separated from second annular surface 166-2 by annular confining surface 166-4. Referring also to FIG. 9, first annular surface 166-1 of annular member 166 also serves as a continuous ceiling over, and between, inlet fluid port 152 and outlet fluid port 154. The plurality of offset members 170, 172 are coupled to annular member 166, and more particularly, the plurality of offset members 170, 172 are connected to first annular surface 166-1 of annular member 166. The plurality of offset members 170, 172 are positioned to extend from annular member 166 in a first axial direction relative to the central axis 176. Each of the plurality of offset members 170, 172 has a free end configured to engage base wall 138 of chamber 148 to establish an axial offset of annular member 166 from base wall 138. Offset member 172 also is positioned and configured to aid in preventing a flow bypass of fluid channel 156.

The plurality of offset members 170, 172 are coupled to annular member 166, and more particularly, the plurality of offset members 170, 172 are connected to second annular surface 166-2 of annular member 166. The plurality of offset members 170, 172 are positioned to extend from annular member 166 in a second axial direction relative to the central axis 176, opposite to the first axial direction.

Thus, when assembled, each of locating features 168-1, 168-2 has a free end that engages a perimetrical portion of diaphragm 130, and each of the plurality of offset members 170, 172 has a free end that engages base wall 138, with base wall 138 facing diaphragm 130.

Figure 12:
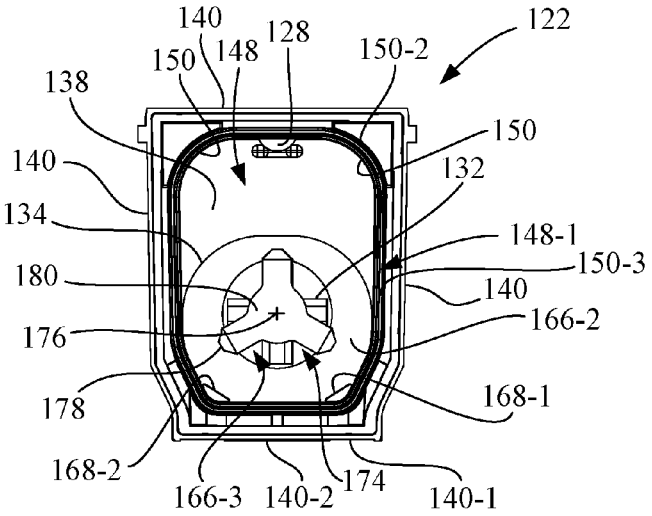
FIG. 12 is an orthogonal view of the body/guide portion/stir bar arrangement of FIG. 11, as viewed in a direction into the body of the chamber toward the base wall of the body.
Figure 13:
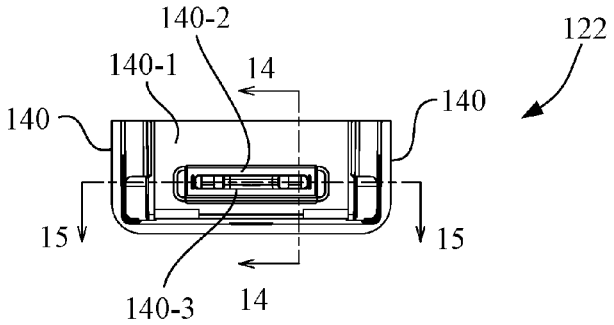
FIG. 13 is an orthogonal end view of the body of FIG. 11, which contains the guide portion and stir bar, as viewed in a direction toward the exterior wall and fluid opening of the body.

Cage structure 174 of guide portion 134 is coupled to annular member 166 opposite to the plurality of offset members 170, 172, and more particularly, the cage structure 174 has a plurality of offset legs 178 connected to second annular surface 166-2 of annular member 166. Cage structure 174 has an axial restraint portion 180 that is axially displaced by the plurality of offset legs 178 (three, as shown) from annular member 166 in the second axial direction opposite to the first axial direction. As shown in FIG. 12, axial restraint portion 180 is positioned over at least a portion of the opening 166-3 in annular member 166 to limit axial movement of stir bar 132 relative to the central axis 176 in the second axial direction. Cage structure 174 also serves to prevent diaphragm 130 from contacting stir bar 132 as diaphragm displacement (collapse) occurs during fluid depletion from fluid reservoir 136.

As such, in the present embodiment, stir bar 132 is confined within the region defined by opening 166-3 and annular confining surface 166-4 of annular member 166, and between axial restraint portion 180 of the cage structure 174 and base wall 138 of chamber 148. The extent to which stir bar 132 is movable within fluid reservoir 136 is determined by the radial tolerances provided between annular confining surface 166-4 and stir bar 132 in the radial direction, and by the axial tolerances between stir bar 132 and the axial limit provided by the combination of base wall 138 and axial restraint portion 180. For example, the tighter the radial and axial tolerances provided by guide portion 134, the less variation of the rotational axis 160 of stir bar 132 from perpendicular relative to base wall 138, and the less side-to-side motion of stir bar 132 within fluid reservoir 136.

In the present embodiment, guide portion 134 is configured as a unitary insert member that is removably attached to housing 112. Guide portion 134 includes retention feature 172-1 and body 122 of housing 112 includes a second retention feature 182. First retention feature 172-1 is engaged with second retention feature 182 to attach guide portion 134 to body 122 of housing 112 in a fixed relationship with housing 112. The first retention feature 172-1/second retention feature 182 may be, for example, in the form of a tab/slot arrangement, or alternatively, a slot/tab arrangement, respectively.

Referring to FIGS. 7 and 15, guide portion 134 may further include a flow control portion 184, which in the present embodiment, also serves as offset member 172. Referring to FIG. 15, flow control portion 184 has a flow separator feature 184-1, a flow rejoining feature 184-2, and a concavely arcuate surface 184-3. Concavely arcuate surface 184-3 is coextensive with, and extends between, each of flow separator feature 184-1 and flow rejoining feature 184-2. Each of flow separator feature 184-1 and flow rejoining feature 184-2 is defined by a respective angled, i.e., beveled, wall. Flow separator feature 184-1 is positioned adjacent inlet fluid port 152 and flow rejoining feature 184-2 is positioned adjacent outlet fluid port 154.

Figure 14:
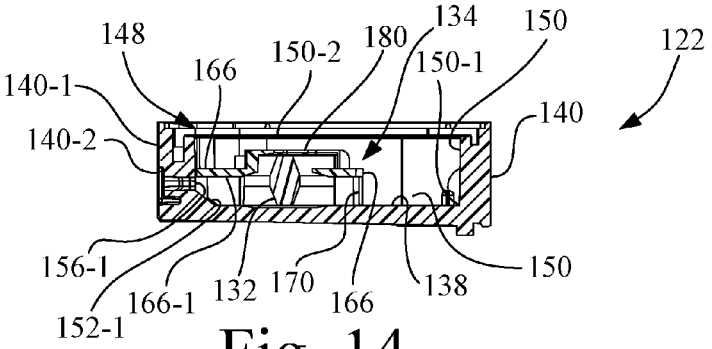
FIG. 14 is a section view of the body/guide portion/stir bar arrangement of FIGS. 12 and 13, taken along line 14-14 of FIG. 13.

The beveled wall of flow separator feature 184-1 positioned adjacent to inlet fluid port 152 of chamber 148 cooperates with beveled inlet ramp 152-1 of inlet fluid port 152 of chamber 148 to guide fluid toward channel inlet 156-1 of fluid channel 156. Flow separator feature 184-1 is configured such that the rotational flow is directed toward channel inlet 156-1 instead of allowing a direct bypass of fluid into the outlet fluid that exits channel outlet 156-2. Referring also to FIGS. 9 and 14, positioned opposite beveled inlet ramp 152-1 is the fluid ceiling provided by first annular surface 166-1 of annular member 166. Flow separator feature 184-1 in combination with the continuous ceiling of annular member 166 and beveled ramp wall provided by beveled inlet ramp 152-1 of inlet fluid port 152 of chamber 148 aids in directing a fluid flow into channel inlet 156-1 of fluid channel 156.

Likewise, referring to FIGS. 9, 14 and 15, the beveled wall of flow rejoining feature 184-2 positioned adjacent to outlet fluid port 154 of chamber 148 cooperates with beveled outlet ramp 154-1 of outlet fluid port 154 to guide fluid away from channel outlet 156-2 of fluid channel 156. Positioned opposite beveled outlet ramp 154-1 is the fluid ceiling provided by first annular surface 166-1 of annular member 166.

In the present embodiment, flow control portion 184 is a unitary structure formed as offset member 172 of guide portion 134. Alternatively, all or a portion of flow control portion 184 may be incorporated into interior perimetrical wall 150 of chamber 148 of body 122 of housing 112.

In the present embodiment, as best shown in FIG. 15, stir bar 132 is oriented such that the plurality of paddles 132-1, 132-2, 132-3, 132-4 periodically face the concavely arcuate surface 184-3 of the flow control portion 184 as stir bar 132 is rotated about the rotational axis 160. Stir bar 132 has a stir bar radius from rotational axis 160 to the free end tip 132-5 of a respective paddle. A ratio of the stir bar radius and a clearance distance between the free end tip 132-5 and flow control portion 184 may be 5:2 to 5:0.025. More particularly, guide portion 134 is configured to confine stir bar 132 in a predetermined portion of the interior space of chamber 148. In the present example, a distance between the respective free end tip 132-5 of each of the plurality of paddles 132-1, 132-2, 132-3, 132-4 and concavely arcuate surface 184-3 of flow control portion 184 is in a range of 2.0 millimeters to 0.1 millimeters, and more preferably, is in a range of 1.0 millimeters to 0.1 millimeters, as the respective free end tip 132-5 faces concavely arcuate surface 184-3. Also, it has been found that it is preferred to position stir bar 132 as close to ejection chip 118 as possible so as to maximize flow through fluid channel 156.

Also, guide portion 134 is configured to position the rotational axis 160 of stir bar 132 in a portion of fluid reservoir 136 such that the free end tip 132-5 of each of the plurality of paddles 132-1, 132-2, 132-3, 132-4 of stir bar 132 rotationally ingresses and egresses a proximal continuous ⅓ volume portion 136-1 that is closer to ejection chip 118. Stated differently, guide portion 134 is configured to position the rotational axis 160 of stir bar 132 in a portion of the interior space such that the free end tip 132-5 of each of the plurality of paddles 132-1, 132-2, 132-3, 132-4 rotationally ingresses and egresses the proximal continuous ⅓ volume portion 136-1 of the interior space of chamber 148 that includes inlet fluid port 152 and outlet fluid port 154.

More particularly, in the present embodiment, wherein stir bar 132 has four paddles, guide portion 134 is configured to position the rotational axis 160 of stir bar 132 in a portion of the interior space such that the first and second free end tips 132-5 of each the two pairs of diametrically opposed paddles 132-1, 132-3 and 132-2, 132-4 alternatingly and respectively are positioned in the proximal continuous ⅓ portion 136-1 of the volume of the interior space of chamber 148 that includes inlet fluid port 152 and outlet fluid port 154 and in the continuous ⅔ volume portion 136-4 having the distal continuous ⅓ portion 136-3 of the interior space that is furthest from ejection chip 118.

Figure 17:
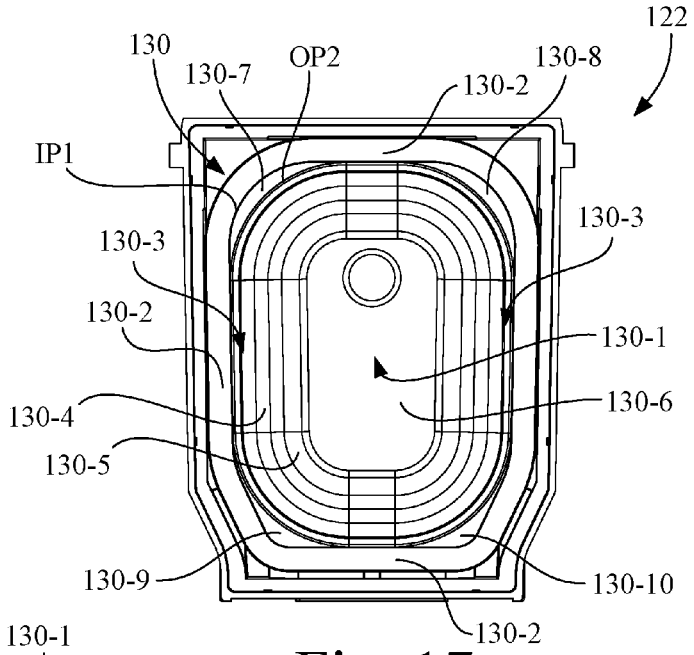
FIG. 17 is a top view of the microfluidic dispensing device of FIG. 1, corresponding to the perspective view of FIG. 10, having the end cap and lid removed to show a top view of the diaphragm that is positioned on the body.

Referring again to FIGS. 6-10, diaphragm 130 is positioned between lid 124 and perimetrical end surface 150-3 of interior perimetrical wall 150 of chamber 148. Referring also to FIGS. 16 and 17, diaphragm 130 is configured for sealing engagement with perimetrical end surface 150-3 of interior perimetrical wall 150 of chamber 148 in forming fluid reservoir 136 (see FIGS. 8 and 9).

Figure 10:
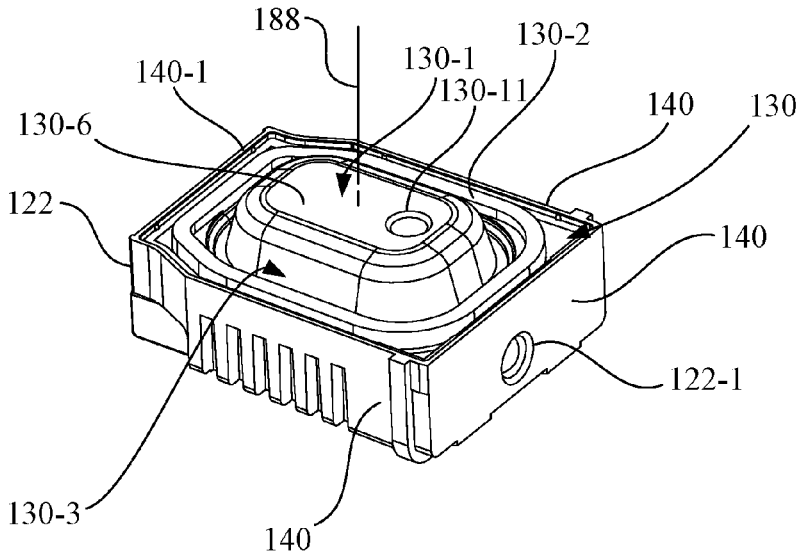
FIG. 10 is a perspective view of the microfluidic dispensing device of FIG. 1, with the end cap and lid removed to expose the body/diaphragm assembly.
Figure 11:
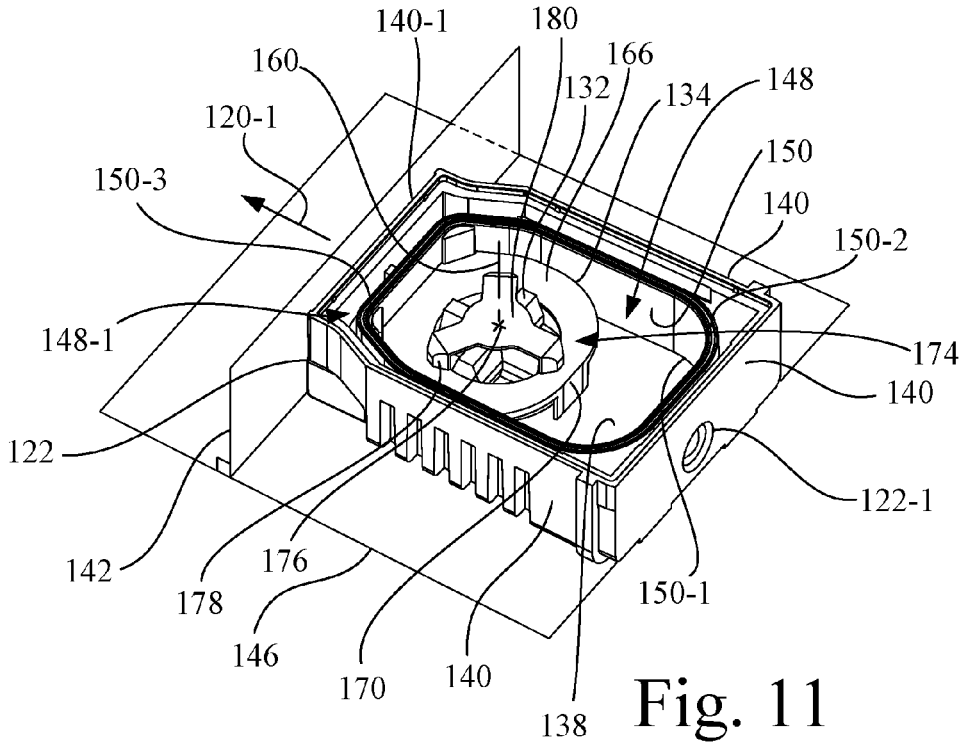
FIG. 11 is a perspective view of the depiction of FIG. 10, with the diaphragm removed to expose the guide portion and stir bar contained in the body, in relation to first and second planes and to the fluid ejection direction.

Referring to FIGS. 10 and 17, diaphragm 130 includes dome portion 130-1 and an exterior perimetrical rim 130-2. Dome portion 130-1 includes a dome deflection portion 130-3, a dome side wall 130-4, a dome transition portion 130-5, a dome crown 130-6, and four web portions, individually identified as central corner web 130-7, central corner web 130-8, central corner web 130-9, and central corner web 130-10. Dome deflection portion 130-3 and the four web portions 130-7, 130-8, 130-9, 130-10 join dome portion 130-1 to exterior perimetrical rim 130-2. In the orientation shown in FIG. 10, dome crown 130-6 includes a slight circular depression 130-11 in the right-most portion of dome crown 130-6 that is a manufacturing feature created during the molding of diaphragm 130, and does not affect the operation of diaphragm 130.

As will be described in more detail below, in the present embodiment, diaphragm 130 is configured such that during the collapse of diaphragm 130 during fluid depletion from fluid reservoir 136, the displacement of dome portion 130-1 is uniform with dome crown 130-6 of diaphragm 130 becoming concave, as viewed from the outside of diaphragm 130, and the direction of collapse, i.e., displacement, of dome portion 130-1 is along a deflection axis 188 that is substantially perpendicular to the fluid ejection direction 120-1 (see also FIG. 11), is substantially perpendicular to plane 146 of base wall 138, and is substantially parallel to plane 142 of chip mounting surface 140-2. In the present embodiment, a position of deflection axis 188 substantially corresponds to a central region of dome portion 130-1. Stated differently, during the collapse of diaphragm 130 during fluid depletion from fluid reservoir 136, the direction of the movement of dome crown 130-6 of dome portion 130-1 of diaphragm 130 is along deflection axis 188 toward base wall 138, and is substantially perpendicular to the fluid ejection direction 120-1, is substantially perpendicular to plane 146 of base wall 138, and is substantially parallel to plane 142 of chip mounting surface 140-2.

Also, as shown in FIGS. 6-10 and 17, microfluidic dispensing device 110 is configured such that diaphragm 130 is oriented to extend across the largest surface area of chamber 148 in forming fluid reservoir 136. As such, advantageously, an amount of movement of dome crown 130-6 of diaphragm 130 required to maintain the desired backpressure in fluid reservoir 136 is less than would be required if a diaphragm were somehow installed at a side wall location of body 122.

Figure 18:
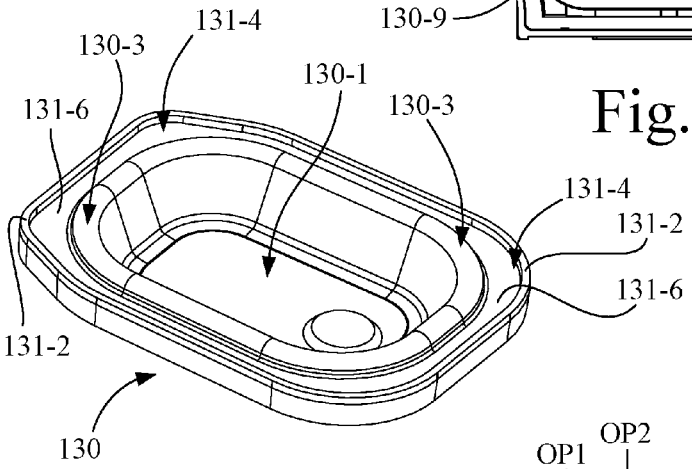
FIG. 18 is a bottom perspective view of the diaphragm of FIG. 17.
Figure 19:
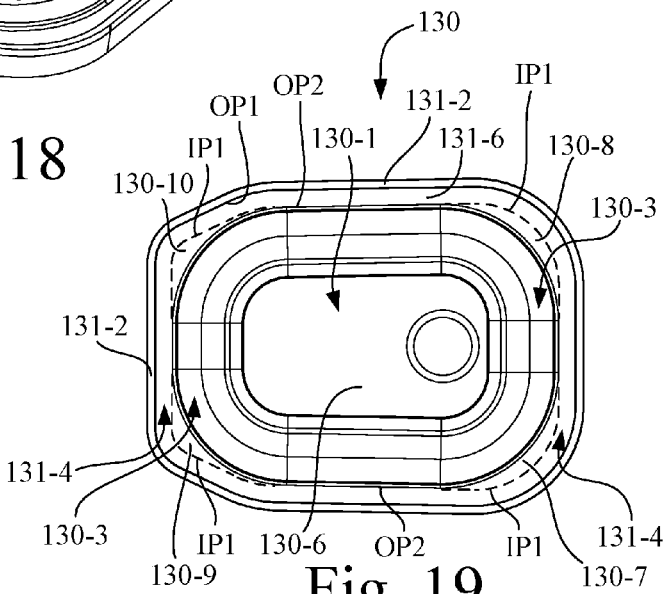
FIG. 19 is a bottom view of the diaphragm of FIGS. 17 and 18.

FIGS. 18 and 19 show a bottom, i.e., interior, view of diaphragm 130, wherein there is shown an interior perimetrical positioning rim 131-2, an interior of dome deflection portion 130-3, and an intermediate interior depressed region 131-4 interposed between interior perimetrical positioning rim 131-2 and dome deflection portion 130-3. Interior perimetrical positioning rim 131-2 aids in locating diaphragm 130 relative to body 122. A base of the intermediate interior depressed region 131-4 defines a continuous perimeter sealing surface 131-6. Referring to FIGS. 16-19, continuous perimeter sealing surface 131-6 has a planar extent that surrounds chamber 148, and with the planar extent being substantially parallel to plane 146 of base wall 138 and substantially perpendicular to plane 142 (see FIG. 11). As such, during the collapse of diaphragm 130 during fluid depletion from fluid reservoir 136, the direction of the movement of dome crown 130-6 of diaphragm 130 is substantially perpendicular to the planar extent of continuous perimeter sealing surface 131-6. Dome deflection portion 130-3 defines an undulated transition between dome side wall 130-4 and continuous perimeter sealing surface 131-6, as will be described in further detail below.

In the present embodiment, for example, interior perimetrical positioning rim 131-2, intermediate interior depressed region 131-4/continuous perimeter sealing surface 131-6, and dome deflection portion 130-3 may be concentrically arranged relative to each other. In the present embodiment, referring to FIG. 19, an outer perimetrical shape of an outer perimeter OP1 of continuous perimeter sealing surface 131-6 coincides with the outer perimetrical shape of interior perimetrical positioning rim 131-2. Referring to FIGS. 17 and 19, an inner perimetrical shape of an inner perimeter IP1 of exterior perimetrical rim 130-2 corresponds to the inner shape of continuous perimeter sealing surface 131-6 (FIG. 19), but inner perimeter IP1 does not coincide with the outer perimetrical shape of the outer perimeter OP2 of dome deflection portion 130-3 because the respective curved corners have different curved shapes, e.g., by having different radii. As such, and referring to FIG. 17, at each respective curved corner between the inner perimetrical shape of the inner perimeter of continuous perimeter sealing surface 131-6 and the outer perimetrical shape of the outer perimeter of dome deflection portion 130-3, there is defined a respective one of central corner webs 130-7, 130-8, 130-9, and 130-10 of diaphragm 130.

Referring also to FIGS. 16 and 23-26, body 122 includes a stepped arrangement that includes a lower channel 122-2, an interior recessed surface 122-3, and an exterior rim 122-4. Exterior rim 122-4 has an upper inner side wall 122-5 that extends downwardly, in the orientation as shown, and vertically terminates at an outer edge of the interior recessed surface 122-3. Channel 122-2 has a lower inner side wall 122-6 that extends upwardly, in the orientation as shown, to vertically terminate at an inner edge of the interior recessed surface 122-3. As such, each of upper inner side wall 122-5 and lower inner side wall 122-6 is substantially perpendicular to the interior recessed surface 122-3, with upper inner side wall 122-5 being laterally offset from lower inner side wall 122-6 by a width of interior recessed surface 122-3, and with upper inner side wall 122-5 and lower inner side wall 122-6 being vertically offset by interior recessed surface 122-3.

Channel 122-2 further includes an inner perimetrical side wall 122-7, that also forms an outer perimeter surface portion of interior perimetrical wall 150, and that is laterally spaced inwardly from the lower inner side wall 122-6, such that inner perimetrical side wall 122-7 is the innermost side wall of channel 122-2 and lower inner side wall 122-6 is the outermost side wall of channel 122-2. In particular, channel 122-2 having lower inner side wall 122-6 and inner perimetrical side wall 122-7 defines a recessed path in body 122 around perimetrical end surface 150-3 of body 122, with the inner perimetrical side wall 122-7 vertically terminating at an outer edge of perimetrical end surface 150-3 of body 122.

Referring to FIGS. 23-26, channel 122-2 of body 122 is sized and shaped to receive and guide interior perimetrical positioning rim 131-2 of diaphragm 130, with interior perimetrical positioning rim 131-2 contacting inner perimetrical side wall 122-7, and with lower inner side wall 122-6 of channel 122-2 of body 122 being intermittently engaged by a perimeter of exterior perimetrical rim 130-2 of diaphragm 130, so as to guide diaphragm 130 into a proper position with body 122. Also, the continuous perimeter sealing surface 131-6 of diaphragm 130 is sized and shaped to engage perimetrical end surface 150-3 of body 122 so as to facilitate a closed sealing engagement of diaphragm 130 with body 122. Thus, when diaphragm 130 is properly positioned relative to body 122 by interior perimetrical positioning rim 131-2 and channel 122-2, continuous perimeter sealing surface 131-6 of diaphragm 130 is positioned to engage perimetrical end surface 150-3 of body 122 around an entirety of perimetrical end surface 150-3. In the present embodiment, perimetrical end surface 150-3 may include a single perimetrical rib, or a plurality of perimetrical ribs or undulations as shown, to provide an effective sealing surface for engagement with continuous perimeter sealing surface 131-6 of diaphragm 130.

Figure 20:
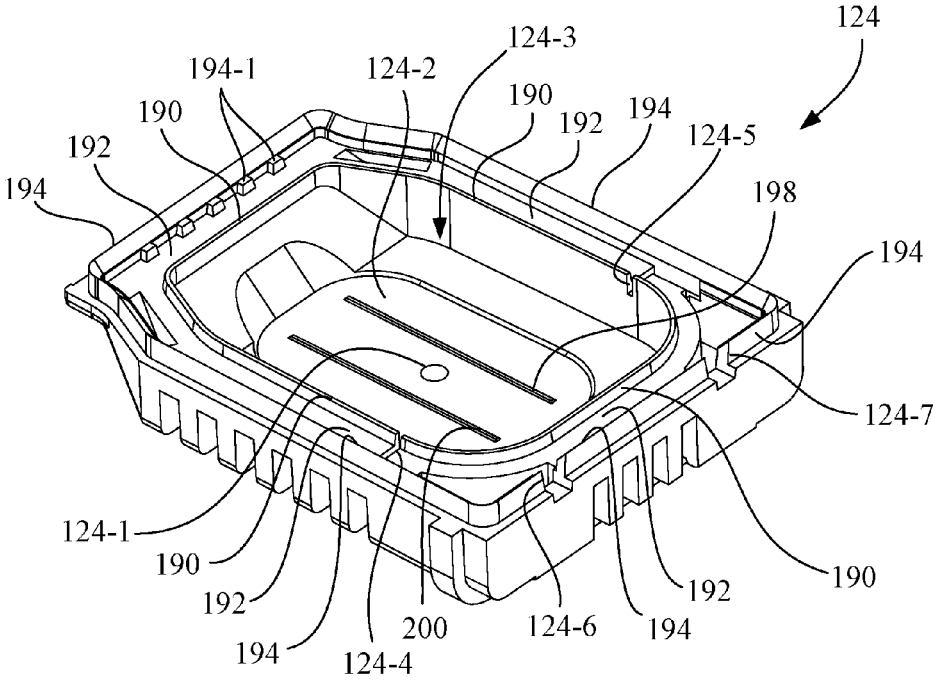
FIG. 20 is a bottom perspective view of the lid of FIGS. 6-9.
Figure 21:
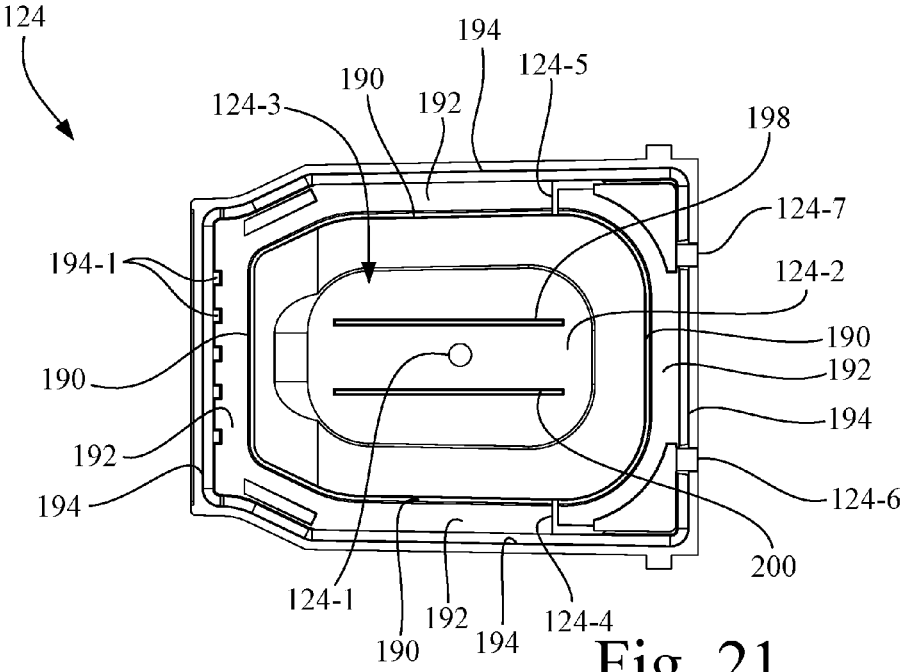
FIG. 21 is a bottom view of the lid of FIGS. 6-9 and 20.

FIGS. 20 and 21 show an interior, or underside, of lid 124 having a recessed interior ceiling 124-2 that defines a recessed region 124-3 that is configured to accommodate a full (non-collapsed) height of dome portion 130-1 of diaphragm 130. Referring also to FIGS. 23-26, lid 124 further includes an interior positioning lip 190, a diaphragm pressing surface 192, and an exterior positioning lip 194, each of which laterally surrounds recessed region 124-3, as best shown in FIGS. 20 and 21. Diaphragm pressing surface 192 is recessed between interior positioning lip 190 and exterior positioning lip 194.

Exterior positioning lip 194 is used to position lid 124 relative to body 122. In particular, during assembly, exterior positioning lip 194 is received and guided by upper inner side wall 122-5 of exterior rim 122-4 into contact with interior recessed surface 122-3 of body 122 (see also FIG. 16). Also, the apex rim (sacrificial material 218; see FIGS. 23-26) of exterior positioning lip 194 will be melted and joined to body 122 at interior recessed surface 122-3 during an ultrasonic welding process to attached lid 124 to body 122. While ultrasonic welding is a current preferred method for attachment of lid 124 to body 122 in the present embodiment, it is contemplated that in some applications, another attachment method may be desired, such as for example, laser welding, mechanical attachment, adhesive attachment, etc.

Referring again to FIGS. 20, 21, and 23-26, interior positioning lip 190 of lid 124 is used to position diaphragm 130 relative to lid 124, and interior perimetrical positioning rim 131-2 of diaphragm 130 is used to position diaphragm 130 relative to body 122. In particular, referring also to FIG. 17, interior positioning lip 190 of lid 124 is sized and shaped to receive thereover the inner perimeter IP1 of exterior perimetrical rim 130-2, so as to position exterior perimetrical rim 130-2 of diaphragm 130 in opposition to diaphragm pressing surface 192 of lid 124.

In addition, referring again to FIGS. 20 and 21, the present embodiment may include a plurality of diaphragm positioning features 194-1 that extend inwardly from exterior positioning lip 194. The plurality of diaphragm positioning features 194-1 are located to engage an external perimeter of exterior perimetrical rim 130-2 of diaphragm 130 to help position diaphragm 130 relative to lid 124. More particularly, in the present embodiment, exterior perimetrical rim 130-2 of diaphragm 130 is received in the region between interior positioning lip 190 of lid 124 and the plurality of diaphragm positioning features 194-1 of lid 124, and interior perimetrical positioning rim 131-2 of diaphragm 130 is positioned in channel 122-2 of body 122, and thereby together help to prevent the dome bending features, such as dome deflection portion 130-3, and continuous perimeter sealing surface 131-6, from being unduly distorted, or continuous perimeter sealing surface 131-6 from leaking, during assembly or negative pressure dome deflections of dome portion 130-1. Also, interior positioning lip 190 of lid 124 and interior perimetrical positioning rim 131-2 of diaphragm 130 collectively limit an amount of seal distortion during collapse of diaphragm 130 when vacuum is generated in fluid reservoir 136 of microfluidic dispensing device 110 during assembly.

Referring again to FIGS. 20 and 21, diaphragm pressing surface 192 of lid 124 is planar, having a uniform height, so as to provide substantially uniform perimeter compression of diaphragm 130 (see also FIGS. 17, 19, and 23-26) at continuous perimeter sealing surface 131-6 around dome portion 130-1. In particular, diaphragm pressing surface 192 of lid 124 is sized and shaped to force continuous perimeter sealing surface 131-6 of diaphragm 130 into sealing engagement with perimetrical end surface 150-3 of body 122 around an entirety of perimetrical end surface 150-3 of body 122, when lid 124 is attached to body 122.

Figure 22:
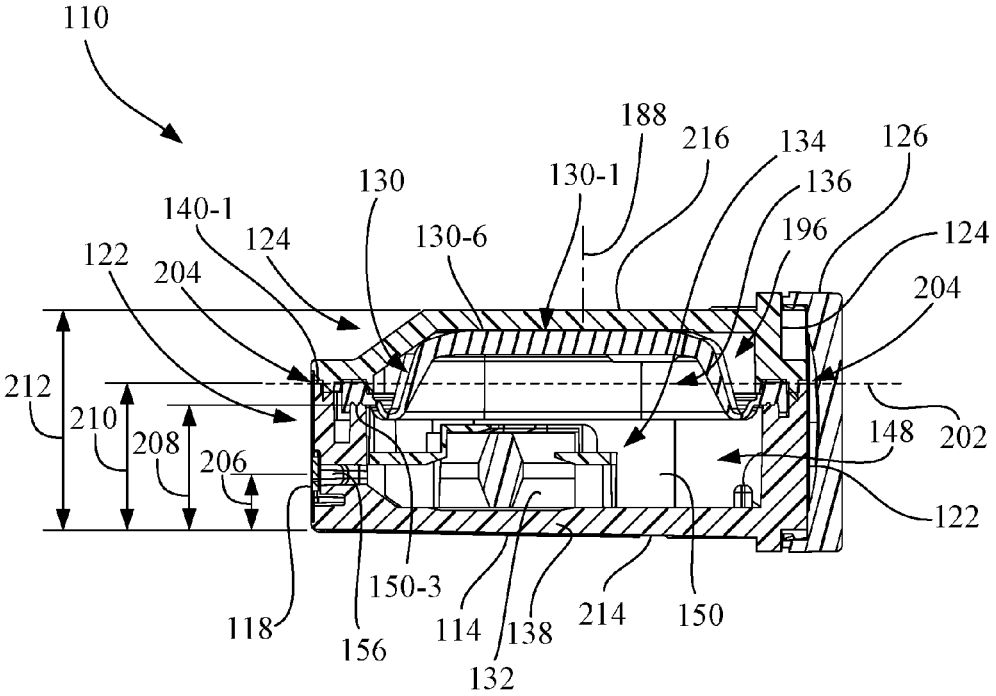
FIG. 22 is an enlarged section view of the microfluidic dispensing device of FIG. 1, taken along line 9-9 of FIG. 5, which identifies distance ranges for the location of certain components of one preferred design of the microfluidic dispensing device of FIG. 1.

Referring also to FIG. 22, a dome vent chamber 196 having a variable volume is defined in the region between dome portion 130-1 of diaphragm 130 and lid 124. As fluid is depleted from fluid reservoir 136, dome portion 130-1 of diaphragm 130 collapses accordingly, thus increasing the volume of dome vent chamber 196, while decreasing the volume of fluid reservoir 136, so as to maintain the desired backpressure in fluid reservoir 136.

Referring again to FIGS. 20 and 21, located on interior ceiling 124-2 of lid 124 is a rib 198 and a rib 200, with rib 198 being spaced apart from rib 200. Vent hole 124-1 is located in lid 124 between ribs 198, 200. Ribs 198, 200 provide a spacing between interior ceiling 124-2 of lid 124 and dome portion 130-1 of diaphragm 130 in a region around vent hole 124-1 (see also FIGS. 17 and 22). As such, ribs 198, 200 help to avoid a sticking contact between dome portion 130-1 of diaphragm 130 and interior ceiling 124-2 of lid 124, which could result in an undesirable de-priming of ejection chip 118 because the sticking would prevent a collapse of dome portion 130-1 as ink is depleted from chamber 148.

As shown in FIGS. 20 and 21, included on opposite sides of, and laterally extending through, interior positioning lip 190 is a dome vent path 124-4 and a dome vent path 124-5, which supplement vent hole 124-1 formed in a central portion of lid 124 in venting the region between dome portion 130-1 of diaphragm 130 and lid 124. Lid 124 further includes a side vent opening 124-6 and a side vent opening 124-7, which are in fluid communication with the atmosphere external to microfluidic dispensing device 110. Each of dome vent paths 124-4, 124-5 is in fluid communication with one or both of side vent openings 124-6, 124-7.

Vent hole 124-1, and the combination of one or more of dome vent path 124-4 and a dome vent path 124-5 with one or more of side vent openings 124-6 and 124-7, facilitate communication of the exterior of dome portion 130-1 with the atmosphere external to microfluidic dispensing device 110 when microfluidic dispensing device 110 is fully assembled, i.e., when lid 124 is attached to body 122.

Vent hole 124-1, dome vent path 124-4, and a dome vent path 124-5 provide venting redundancy to the region between dome portion 130-1 of diaphragm 130 and the interior ceiling 124-2 of lid 124, so as to facilitate a collapse of dome portion 130-1 as fluid is depleted from microfluidic dispensing device 110, even if one or more, but not all, of the vent hole 124-1 and side vent openings 124-6, 124-7 is blocked. For example, even if vent hole 124-1 was blocked, such as by product labeling, venting of the region between dome portion 130-1 and lid 124 is maintained by one or more of dome vent path 124-4 and a dome vent path 124-5 via one or more of side vent openings 124-6, 124-7.

Referring again to FIG. 22, microfluidic dispensing device 110 is configured with an external split 202 (depicted by a dashed horizontal line) at a juncture of body 122 and lid 124. During ultrasonic welding of lid 124 to body 122, an external perimetrical gap 204 between body 122 and lid 124 at split 202 is reduced as material is melted and reformed at the junction of lid 124 and body 122.

Split 202 is perpendicular to the chip mounting surface 140-2 and the orientation of ejection chip 118. The location of split 202 is designed such that body 122, and not lid 124, defines the chip mounting surface 140-2, fluid channel 156, fluid reservoir 136, and the perimetrical end surface 150-3 (that contacts the continuous perimeter sealing surface 131-6 of diaphragm 130). Split 202 is positioned away from chip mounting surface 140-2 and fluid channel 156 to minimize distortion issues in the chip pocket and fluid channel areas during the processes such as welding or chip attachment. Also, split 202 is positioned away from chip mounting surface 140-2 and fluid channel 156 to minimize post manufacturing issues, such as sensitivity to handling or chip stress.

The location of split 202 also is positioned so that lid 124 has sufficient structure to allow uniform compression of the continuous perimeter sealing surface 131-6 of diaphragm 130. Diaphragm 130 has sufficient material thickness in the region of continuous perimeter sealing surface 131-6 to prevent loss of seal compression during the life of microfluidic dispensing device 110. Lid 124 defines a raised section (recessed region 124-3; see FIGS. 20 and 21) that accommodates dome vent chamber 196 and dome portion 130-1 of diaphragm 130, so that there is displaceable volume (i.e., a portion of fluid reservoir 136) that is located above the perimetrical end surface 150-3 of body 122, that contacts the continuous perimeter sealing surface 131-6 of diaphragm 130.

To achieve the advantages set forth above, in one preferred design of microfluidic dispensing device 110, design criteria has been established that defines distance ranges for the location of certain components of the design.

Referring to FIG. 22, in conjunction with FIGS. 17-21, four distance ranges are defined, as follows: distance 206, distance 208, distance 210, and distance 212.

Distance 206 is the distance (length, e.g., height) from exterior base surface 214 of base wall 138 of body 122 to the vertical center of ejection chip 118, which corresponds to the center of the chip mounting surface 140-2, i.e., the chip pocket, (see FIG. 7) which holds ejection chip 118. As alternatively defined, distance 206 is the distance from exterior base surface 214 of base wall 138 of body 122 to the vertical center of fluid channel 156.

Distance 208 is the distance (length, e.g., height) from exterior base surface 214 of base wall 138 of body 122 to the perimetrical end surface 150-3 of interior perimetrical wall 150 of body 122, wherein interior perimetrical wall 150 defines a portion of fluid reservoir 136 and the height of chamber 148.

Distance 210 is the distance (length, e.g., height) from exterior base surface 214 of base wall 138 of body 122 to the top of exterior wall 140-1 of body 122 at the location of split 202.

Distance 212 is the distance (length, e.g., height) from exterior base surface 214 of base wall 138 of body 122 to the top of a portion 216 of lid 124 around recessed region 124-3 that accommodates dome portion 130-1 of diaphragm 130, e.g., portion 216 of lid 124 that internally is variably spaced from adjacent dome crown 130-6 of diaphragm 130 by a displacement of dome crown 130-6 of diaphragm 130.

The relationship between the distances 206, 208, 210, 212 are defined by the following mathematical expressions:

$$A<B<D; A<C<D;$$

$$20\%<(A/C)<80\%; 20\%<(A/B)<80\%;$$

$$40\%<(C/D)<95\%; \text{ and } 40\%<(B/D)<95\%, \text{ wherein:}$$

A=distance 206; B=distance 208; C=distance 210; and D=distance 212.

Stated differently, referring to FIG. 22, the ratio of the distance 206 and distance 210 is in a range of 20 percent to 80 percent, the ratio of the distance 206 and distance 208 is in a range of 20 percent to 80 percent, the ratio of the distance 210 and distance 212 is in a range of 40 percent to 95 percent, and the ratio of the distance 208 and distance 212 is in a range of 40 percent to 95 percent, and wherein distance 206 is less than distance 208 and distance 208 is less than distance 212; and, distance 206 is less than distance 210 and distance 210 is less than distance 212.

Figure 23:
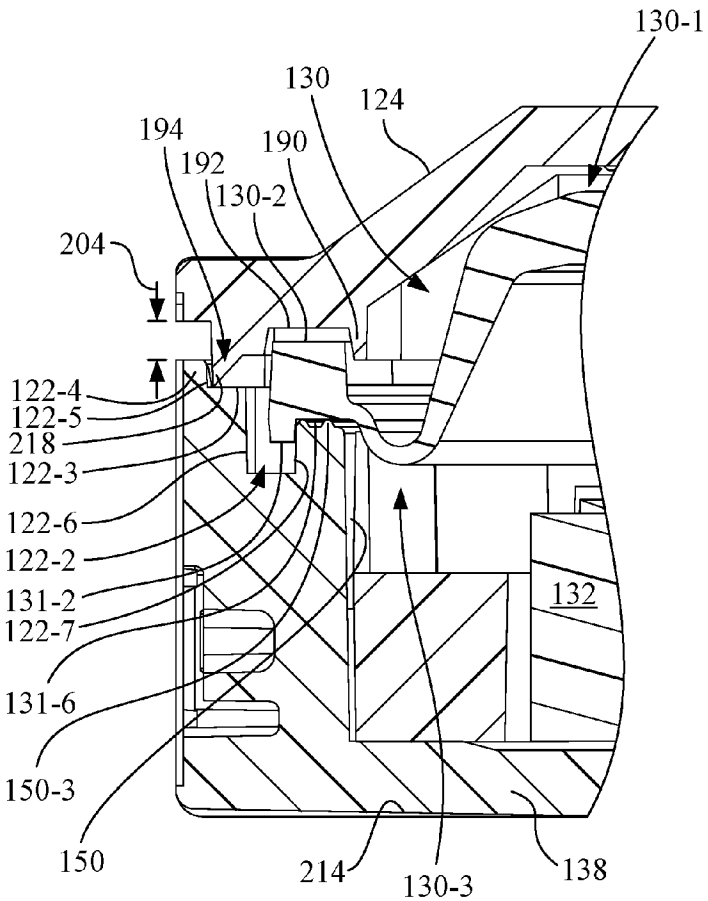
FIG. 23 is a further enlarged section view corresponding to a portion of FIG. 22, showing component positions of the microfluidic dispensing device prior to welding the lid to the body.
Figure 26:
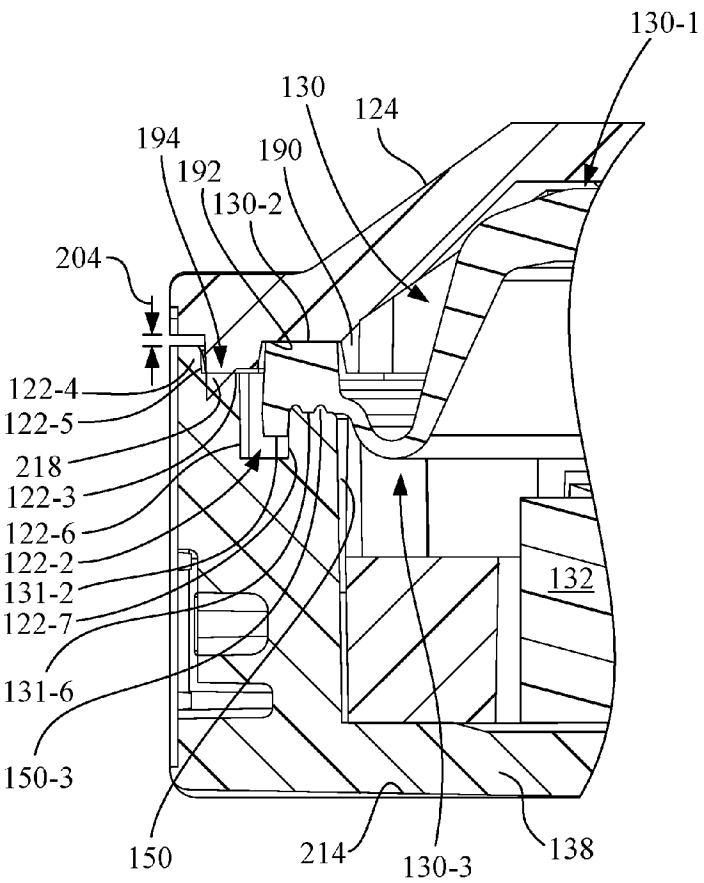
FIG. 26 is a further enlarged section view corresponding to a portion of FIG. 22, showing component positions of the microfluidic dispensing device at the end of the welding process, with the lid securely attached to the body.

Referring to FIGS. 23-26, the attachment of lid 124 to body 122 compresses a perimeter of diaphragm 130 thereby creating a continuous seal between diaphragm 130 and body 122. FIGS. 23-26, for example, respectively illustrate four example stages of compression of the perimeter of diaphragm 130 as lid 124 is attached to body 122 via ultrasonic welding, wherein FIG. 23 depicts component positions prior to welding lid 124 to body 122, and FIG. 26 depicts component positions at the end of the welding process, with lid 124 securely attached to body 122.

Referring to FIGS. 23-26, during the ultrasonic welding process, the perimetrical gap 204 is progressively reduced as sacrificial material 218 is melted from exterior positioning lip 194 of lid 124 and redistributed in joining lid 124 to body 122. In doing so, a compressive force is applied to exterior perimetrical rim 130-2 of diaphragm 130 by diaphragm pressing surface 192 of lid 124. Stated differently, exterior perimetrical rim 130-2 of diaphragm 130 is compressed between diaphragm pressing surface 192 of lid 124 and perimetrical end surface 150-3 of body 122 so as to engage continuous perimeter sealing surface 131-6 of diaphragm 130 in sealing engagement with perimetrical end surface 150-3 of body 122.

During the welding process, interior positioning lip 190 and exterior positioning lip 194 (including diaphragm positioning features 194-1 shown in FIGS. 20 and 21) of lid 124, and interior perimetrical positioning rim 131-2 of diaphragm 130, together help to prevent the dome bending features, such as dome deflection portion 130-3, and continuous perimeter sealing surface 131-6, from being unduly distorted, or continuous perimeter sealing surface 131-6 from leaking.

Figure 24:
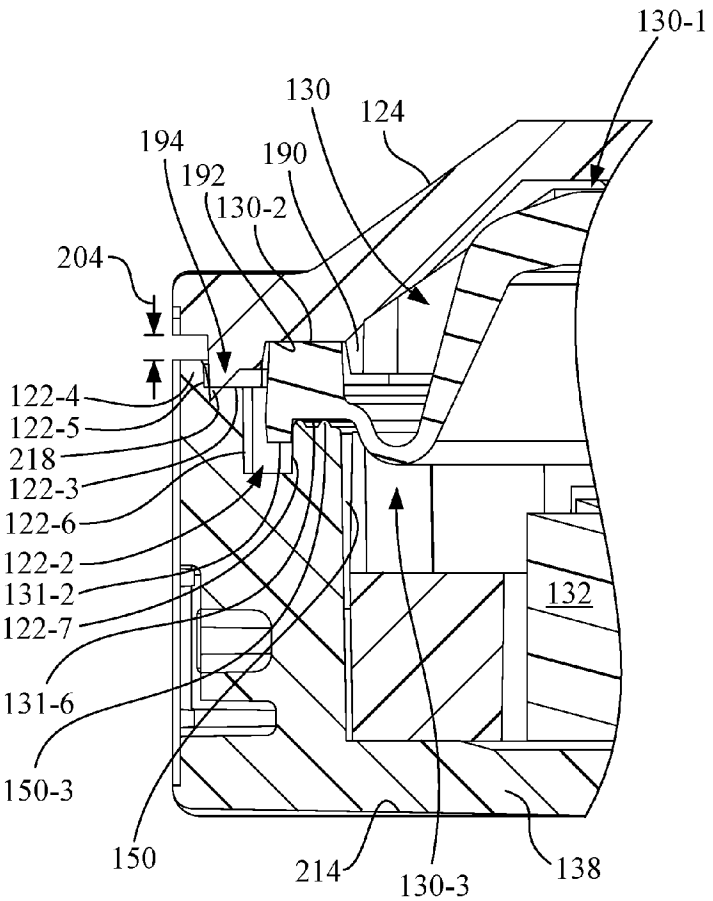
FIG. 24 is a further enlarged section view corresponding to a portion of FIG. 22, showing component positions of the microfluidic dispensing device during an initial intermediate stage of welding the lid to the body.
Figure 25:
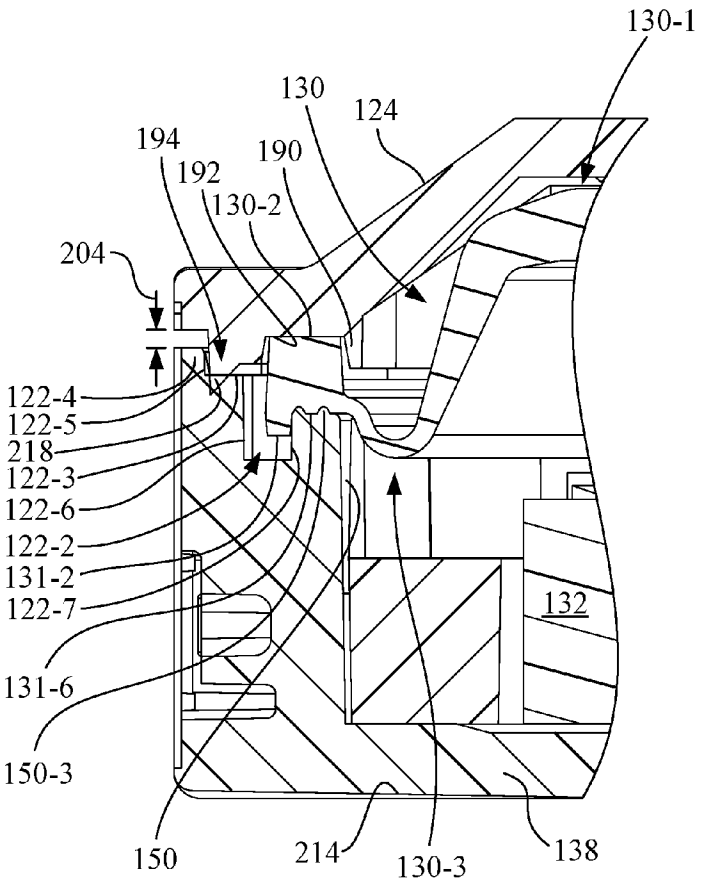
FIG. 25 is a further enlarged section view corresponding to a portion of FIG. 22, showing component positions of the microfluidic dispensing device during a later intermediate stage of welding the lid to the body.

Again, by way of example, FIGS. 23-26 respectively illustrate four example stages within the progressive compression of exterior perimetrical rim 130-2 of diaphragm 130 as lid 124 is attached to body 122 via ultrasonic welding. FIG. 23 depicts component positions prior to welding lid 124 to body 122, and in this example, perimetrical gap 204 is 850 microns, wherein the weld distance is 0.0 microns and the elastomeric material compression of exterior perimetrical rim 130-2 of diaphragm 130 is −312 microns. The negative value for elastomeric material compression means that there is a gap between diaphragm pressing surface 192 of lid 124 and exterior perimetrical rim 130-2 of diaphragm 130. FIG. 24 depicts component positions during an initial intermediate stage of welding lid 124 to body 122, with perimetrical gap 204 at 538 microns, wherein the weld distance is 312 microns and the elastomeric material compression of exterior perimetrical rim 130-2 of diaphragm 130 is 0.0 microns, i.e., initial contact of diaphragm pressing surface 192 of lid 124 with exterior perimetrical rim 130-2 of diaphragm 130. FIG. 25 depicts component positions during a later intermediate stage of welding lid 124 to body 122, with perimetrical gap 204 at 388 microns, wherein the weld distance is 462 microns and the elastomeric material compression of exterior perimetrical rim 130-2 of diaphragm 130 is 150 microns, i.e., diaphragm pressing surface 192 of lid 124 is engaged with and compressing exterior perimetrical rim 130-2 of diaphragm 130 against perimetrical end surface 150-3 of body 122. FIG. 26 depicts component positions at the completion of welding lid 124 to body 122, with perimetrical gap 204 at 238 microns, wherein the weld distance is 612 microns and the elastomeric material compression of exterior perimetrical rim 130-2 of diaphragm 130 is 300 microns, i.e., diaphragm pressing surface 192 of lid 124 is at maximum compression of exterior perimetrical rim 130-2 of diaphragm 130.

Figure 27:
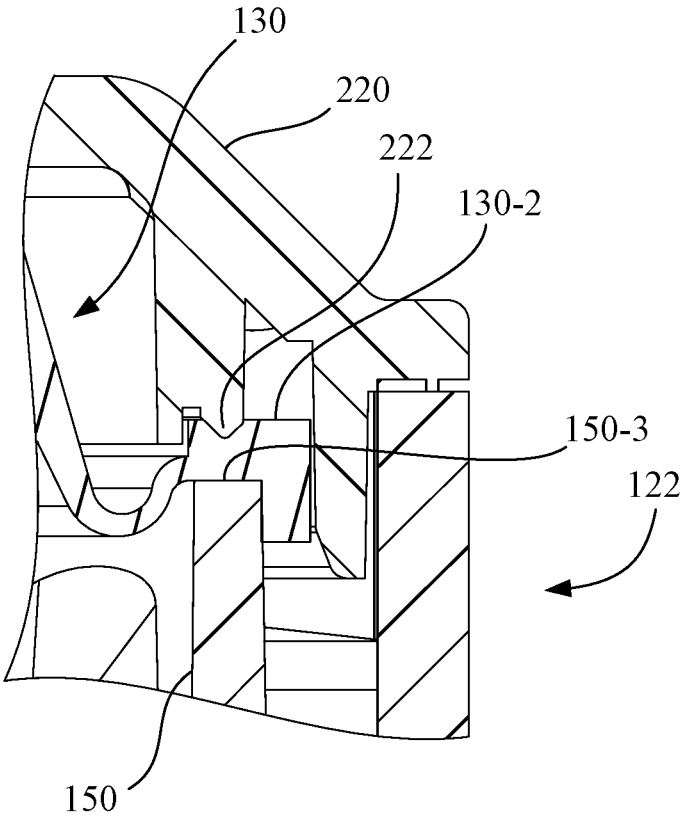
FIG. 27 is a section view that shows a modification to the design depicted in FIGS. 23-26, wherein the diaphragm pressing surface of the lid has a downwardly facing perimetrical protrusion that engages the exterior perimetrical rim of the diaphragm.

FIG. 27 shows a modification to the design depicted in FIGS. 23-26, wherein the diaphragm pressing surface 192 of lid 124 of FIGS. 23-26 is modified to form a lid 220 having a downwardly facing perimetrical protrusion 222 that is cone-like in cross-section, and engages exterior perimetrical rim 130-2 of diaphragm 130, to force exterior perimetrical rim 130-2 into sealing engagement with perimetrical end surface 150-3 of body 122. In the present embodiment, perimetrical end surface 150-3 of body 122 may be flat, or may include one or more upwardly facing perimetrical ribs or undulations, to provide an effective sealing surface for engagement with diaphragm 130.

As mentioned above, it is desirable to maintain some backpressure in fluid reservoir 136 so as to prevent weeping of fluid from ejection chip 118. However, if the backpressure becomes too high, thus causing air ingestion through the nozzles, then an inadequate amount of fluid may be delivered to ejection chip 118, thus resulting in erratic fluid expulsion, if any, from ejection chip 118.

In the examples provided above, backpressure (negative pressure) is generated in fluid reservoir 136, with diaphragm 130 being configured to balance forces and active areas to achieve the desired backpressure.

Diaphragm 130 is made of elastomeric material, and thus the force generated by diaphragm 130 is through deformation of the elastomeric material, e.g., bending and/or stretching of the elastomeric material, in the regions of dome portion 130-1 and/or dome deflection portion 130-3. Deformation of the elastomeric material forming diaphragm 130 may be dependent on such factors as the wall thickness of regions of diaphragm 130, the cross-section profile shape (e.g., undulations, straight vs. curved, etc.) of regions of diaphragm 130, and/or durometer of the elastomeric material. The effective area over which this force is applied is the movable portion of the elastomeric material i.e., dome portion 130-1 and/or dome deflection portion 130-3 of diaphragm 130, that is located laterally inwardly away from the stationary support provided by perimetrical end surface 150-3 of body 122.

Figure 28:
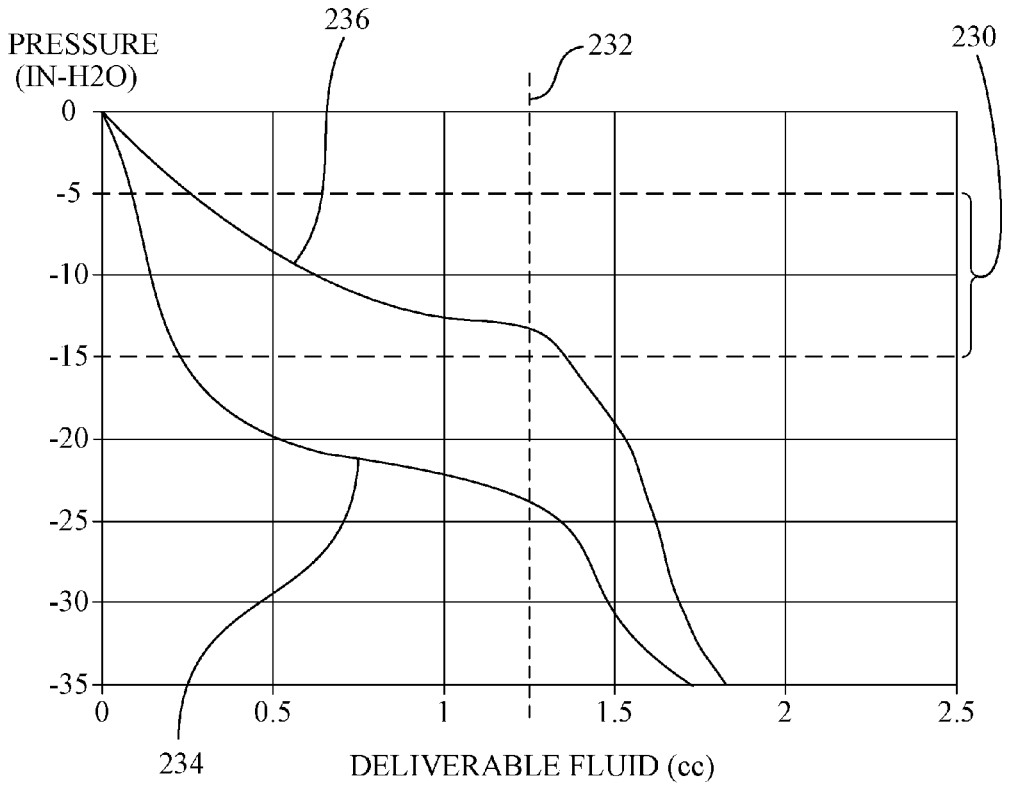
FIG. 28 is a graph showing an ideal backpressure range for the microfluidic dispensing device of FIGS. 1-26, and plotting pressure versus deliverable fluid for two diaphragm designs.

FIG. 28 is a graph showing an ideal backpressure range 230 for microfluidic dispensing device 110 having a stir bar guide, such as guide portion 134 (see also FIGS. 1 and 6). In the present example, the ideal backpressure range 230 is a range of −5 to −15 inches $H_2O$ through the range of deliverable fluid, i.e., to the end of the lifetime 232 of microfluidic dispensing device 110, as represented on the graph of FIG. 28 by the vertical dashed line. Those skilled in the art will recognize that the ideal backpressure range 230 for a given fluidic dispensing device design may differ from the range identified above, depending on such factors as variations in the size of the fluidic dispensing device, the capacity of the fluid reservoir, and/or the amount of fluid in the reservoir.

In FIG. 28, curve 234 represents an initial design for a diaphragm for use in microfluidic dispensing device 110, and curve 236 represents a refinement of the diaphragm design from the initial design to achieve the ideal backpressure range 230 for the lifetime 232 of microfluidic dispensing device 110. In the general configuration of the diaphragm, e.g., diaphragm 130, dome backpressure increases and starts to become more constant (e.g., at fluid depletion of 0.5 cubic centimeters (cc) in this example) as the rolling of the elastomeric material occurs at dome deflection portion 130-3 and/or dome side wall 130-4 of dome portion 130-1.

Each of curves 234 and 236 illustrate the end of the useful life of a respective microfluidic dispensing device at lifetime 232, which in the present example occurs at 1.25 cc of fluid depletion, that is characterized by a sharp increase in backpressure (a sharp decrease in pressure). For example, referring also to FIG. 22, it has been observed that when diaphragm 130 has collapsed to the point where dome portion 130-1, e.g., dome crown 130-6, starts to contact features (e.g., a stir bar guide or stir bar) internal to fluid reservoir 136, the rate of backpressure change increases, since the design of diaphragm 130 can no longer adequately counteract the backpressure increase due to further fluid depletion (fluid expulsion) from fluid reservoir 136.

While it may be possible to extend the lifetime 232 somewhat by removal of the stir bar guide, it is noted that the stir bar guide, such as guide portion 134, advantageously prevents dome portion 130-1, e.g., dome crown 130-6, from contacting the stir bar, e.g., stir bar 132, thereby preventing the collapse of diaphragm 130 from impeding rotation of stir bar 132, resulting in a loss of mixing capability. Stated differently, in the present example having guide portion 134, the effective range of deflection of dome portion 130-1 along deflection axis 188 that corresponds to the lifetime 232 is the distance from the maximum height of dome crown 130-6 over base wall 138 to the height of guide portion 134 over base wall 138, i.e., the position where dome portion 130-1 contacts guide portion 134.

In FIG. 28, curve 234 represents an initial design for a diaphragm for use in microfluidic dispensing device 110, which is shown to provide undesirable results relative to the ideal backpressure range 230, since after 0.25 cc fluid depletion the backpressure exceeds the maximum backpressure of the ideal backpressure range 230, e.g., a backpressure greater than −15 inches $H_2O$ in this example. In practice, it is desirable for microfluidic dispensing device 110 to enter the ideal backpressure range 230 as quickly as possible, and then remain in the ideal backpressure range 230 throughout the lifetime 232 of microfluidic dispensing device 110, as generally depicted by curve 236. Thus, for an initial design that does not achieve the desired backpressure criteria, as represented by curve 234, diaphragm design refinements are desirable such that the backpressure versus fluid depletion characteristics of microfluidic dispensing device 110 of the present design more closely emulate the curve 236 during the lifetime 232.

While the construction of fluidic dispensing devices in accordance with the present invention may vary in size and fluid capacity, the general construction and operating principles remain the same throughout. As such, one skilled in the art will recognize that the ideal backpressure range 230 and curve 236 depicted by example in FIG. 28 is specific to a microfluidic dispensing device, such as microfluidic dispensing device 110, and that other ideal backpressure ranges and/or operation curves may be established to take into account the size and fluid capacity differences of various fluidic dispensing devices.

Referring now to FIGS. 29A-C, 30A-C, and 31A-C, there is shown three examples of variations on the diaphragm design that may be used to approximate operation curve 236, which during its lifetime 232 does not have a backpressure that exceeds the maximum backpressure, e.g., a backpressure less than −15 inches $H_2O$ in this example, of the ideal backpressure range 230, depicted in FIG. 28. Each of FIGS. 29A-C, 30A-C, and 31A-C show the respective diaphragm 130, 260, 280 in its rest state, i.e., under no backpressure.

Each of diaphragms 130, 260, 280 is configured to collapse along deflection axis 188 in a direction that is initially toward, and then away from, the plane of continuous perimeter sealing surface 131-6, wherein the deflection axis 188 is substantially perpendicular to the plane of continuous perimeter sealing surface 131-6. Also, each of diaphragms 130, 260, 280 has a cross-section profile (e.g., shape and/or taper and/or thickness) that is selected to control the deflection, i.e., collapse, of the respective dome portion 130-1, 260-1, 280-1 at a given backpressure represented by the graph of FIG. 28.

Figure 29A:
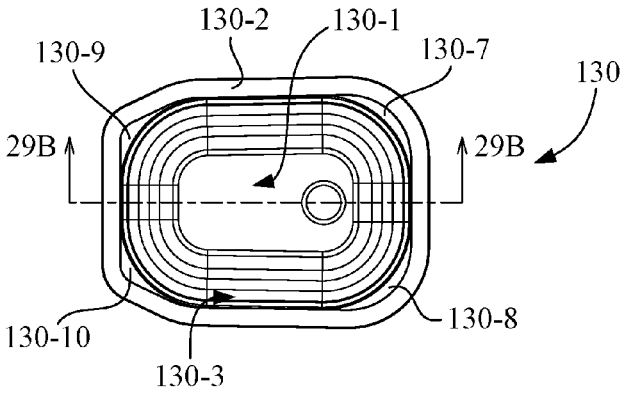
FIG. 29A is a top view of the diaphragm of the microfluidic dispensing device of FIGS. 1-26.
Figure 29B:
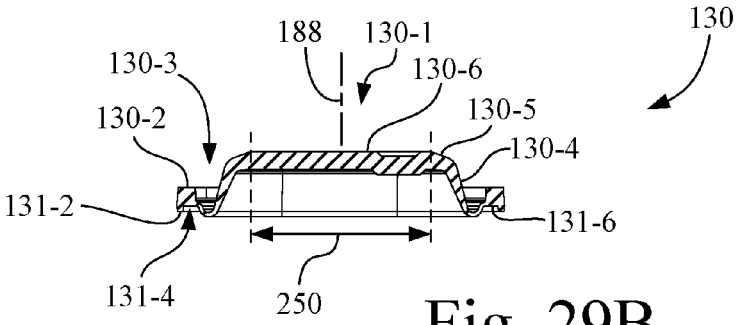
FIG. 29B is a section view of the diaphragm of FIG. 29A, taken along line 29B-29B of FIG. 29A.
Figure 29C:
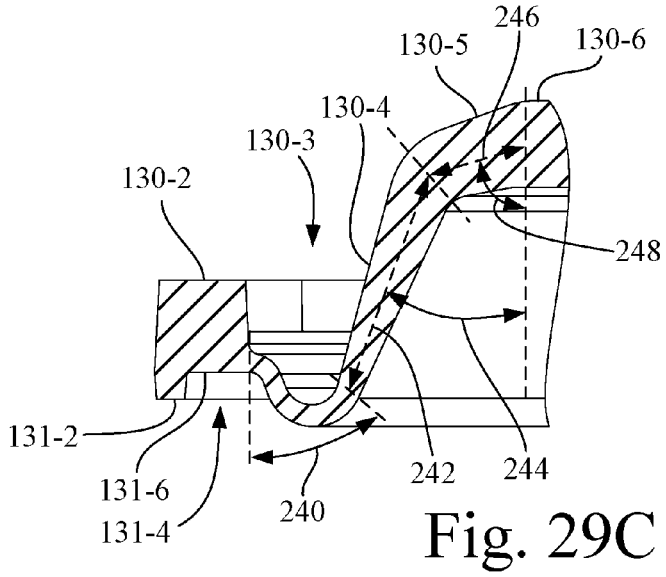
FIG. 29C is an enlargement of a portion of the section view of FIG. 29B.

FIGS. 29A-29C show diaphragm 130, as described above, in a horizontal orientation, i.e., a planar extent of continuous perimeter sealing surface 131-6 is horizontal, as shown. As best shown in FIGS. 29B and 29C, the portions of diaphragm 130 that have an influence on the collapse characteristics of diaphragm 130 during fluid depletion are dome deflection portion 130-3, dome side wall 130-4, dome transition portion 130-5, and dome crown 130-6.

Dome deflection portion 130-3 has a curved S-shaped configuration in cross-section having a curved extent 240. Dome side wall 130-4 has a tapered cross-section profile, i.e., the wall thickness increases in a direction from the dome deflection portion 130-3 to dome transition portion 130-5, and has a straight extent 242 at an off-vertical angle 244 of 22±3 degrees relative to the vertical axis at the juncture of dome transition portion 130-5 and dome crown 130-6. Dome transition portion 130-5 has substantially uniform thickness (i.e., ±5 percent uniform thickness) in cross-section, having a straight extent 246 at an off-vertical angle 248 of 72±3 degrees. Dome crown 130-6 has substantially uniform thickness in cross-section, having a straight extent 250 and is horizontal, i.e., with an off-vertical angle of 90 degrees, such that a planar extent of dome crown 130-6 is substantially perpendicular to a plane of continuous perimeter sealing surface 131-6. The hardness of the elastomeric material constituting diaphragm 130 is 40±3 durometer. This configuration was found to achieve the pressure versus deliverable fluid curve 236 of FIG. 28, with a backpressure variation range of plus or minus five percent.

Figure 30A:
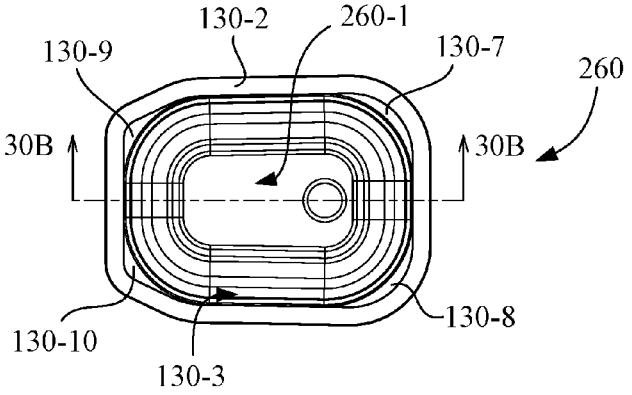
FIG. 30A is a top view of an alternative diaphragm for use with the microfluidic dispensing device of FIGS. 1-26.
Figure 30B:
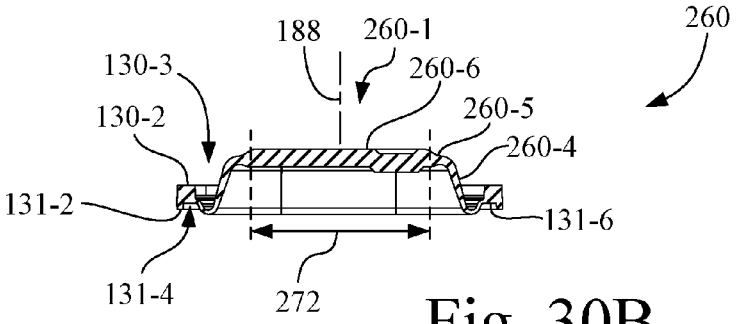
FIG. 30B is a section view of the diaphragm of FIG. 30A, taken along line 30B-30B of FIG. 30A.
Figure 30C:
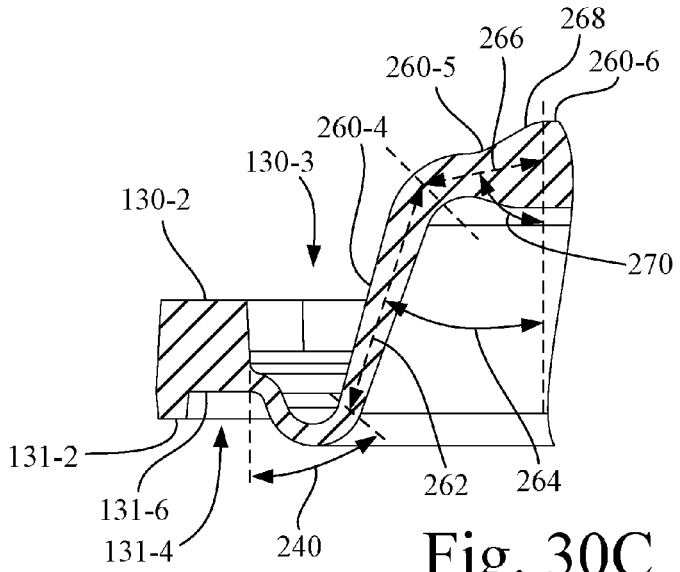
FIG. 30C is an enlargement of a portion of the section view of FIG. 30B.

FIGS. 30A-30C show a diaphragm 260, which is designed as a suitable replacement for diaphragm described above. Diaphragm 260 has in common with diaphragm 130 the exterior perimetrical rim 130-2; dome deflection portion 130-3; four web portions 130-7, 130-8, 130-9, 130-10; interior perimetrical positioning rim 131-2, intermediate interior depressed region 131-4; and continuous perimeter sealing surface 131-6. For purposes of discussion, diaphragm 260 is in a horizontal orientation, i.e., the planar extent of continuous perimeter sealing surface 131-6 is horizontal, as shown. As best shown in FIGS. 30B and 30C, the portions of diaphragm 260 that have an influence on the collapse characteristics of diaphragm 260 during fluid depletion are dome deflection portion 130-3 and dome portion 260-1 having dome side wall 260-4, dome transition portion 260-5, and dome crown 260-6.

Dome deflection portion 130-3 has a curved S-shaped configuration in cross-section having a curved extent 240, and is identical to the corresponding cross-section of diaphragm 130.

Dome side wall 260-4 has a tapered cross-section profile, i.e., the wall thickness increases in a direction from the dome deflection portion 130-3 to dome transition portion 260-5, and has a straight extent 262 at an off-vertical angle 264 of 17±3 degrees relative to the vertical axis at the juncture of dome transition portion 260-5 and dome crown 260-6. While dome side wall 260-4 is similar in cross-section profile to dome side wall 130-4 of diaphragm 130, it is noted that the amount of taper of dome side wall 260-4 is less than dome side wall 130-4 of diaphragm 130. As such, dome side wall 260-4 has a thinner cross-section profile than dome side wall 130-4 of diaphragm 130. It has been found that changing the thickness of the dome side wall of the dome portion has an effect of changing the elasticity, i.e., stretchiness, of the dome side wall along its length, e.g., height, and thus having an effect on the deflection of the respective dome portion along deflection axis 188.

Dome transition portion 260-5 has non-uniform thickness in cross-section, having a curved extent 266 having a bell-like flared portion 268 in cross-section that flares in thickness to join with dome crown 260-6. Curved extent 266 is oriented at an off-vertical angle 270 of 80±3 degrees.

Dome crown 260-6 has substantially uniform thickness, having a straight extent 272 and is horizontal, i.e., with an off-vertical angle of 90 degrees. The hardness of the elastomeric material constituting diaphragm 260 is 50±3 durometer. This configuration was found to achieve the pressure versus deliverable fluid curve 236 of FIG. 28, with a backpressure variation range of plus or minus five percent.

Thus, each of diaphragm 130 and diaphragm 260 was able to achieve the pressure versus deliverable fluid curve 236 of FIG. 28. However, in comparison to diaphragm 130, diaphragm 260 was able to do so using a higher durometer elastomeric material by reducing the amount of wall thickness of dome side wall 260-4, and by reducing the thickness and adopting a curved bell-like shape for dome transition portion 260-5. However, the more complex shape of diaphragm 260 may increase manufacturing complexity over that of diaphragm 130.

Thus, changes in the cross-section profile of a respective diaphragm are effected by at least one of changing a shape of the dome transition portion, and changing an amount of a taper of the dome side wall in a direction toward the dome transition portion, thereby changing a thickness of the dome side wall. Further, at least one of a cross-section profile taper/thickness of the dome side wall and a shape of the dome transition portion may be selected based at least in part on the durometer of the elastomeric material selected for use for manufacturing the respective diaphragm. It is further noted that differences in the angular relationships of the dome side wall and the dome transition portion may be realized to accommodate the change in taper/thickness and/or shape of the cross-section profile.

Figure 31A:
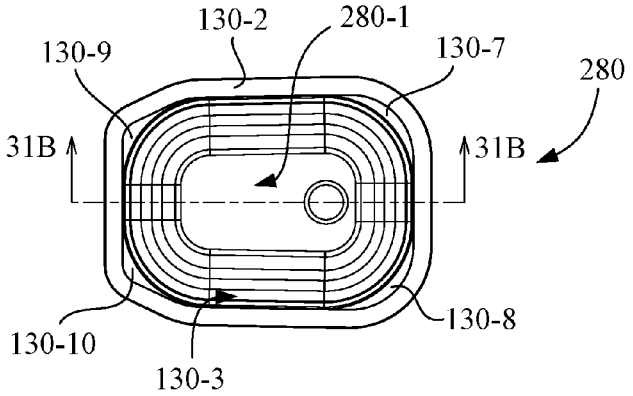
FIG. 31A is a top view of another alternative diaphragm for use with the microfluidic dispensing device of FIGS. 1-26.
Figure 31B:
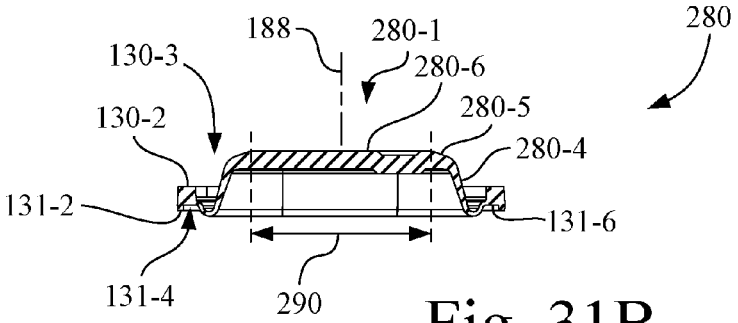
FIG. 31B is a section view of the diaphragm of FIG. 31A, taken along line 31B-31B of FIG. 31A.
Figure 31C:
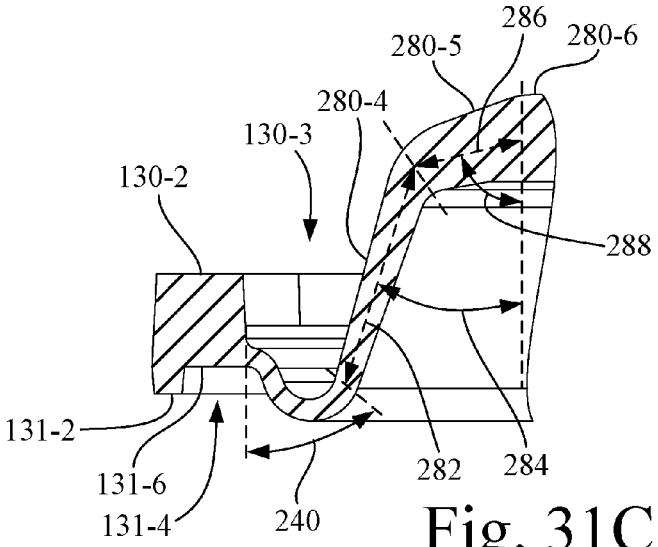
FIG. 31C is an enlargement of a portion of the section view of FIG. 31B.

FIGS. 31A-31C show a diaphragm 280, which is designed as a suitable replacement for diaphragms 130 and/or 260 described above. Diaphragm 280 is similar in many respects to diaphragm 130, except for the use of a higher durometer elastomeric material and the use of a dome portion 280-1 having a thinner dome side wall 280-4. For purposes of discussion, diaphragm 280 is in a horizontal orientation, i.e., the planar extent of continuous perimeter sealing surface 131-6 is horizontal, as shown. As best shown in FIGS. 31B and 31C, the portions of diaphragm 280 that have an influence on the collapse characteristics of diaphragm 280 during fluid depletion are dome deflection portion 130-3, and dome portion 280-1 having dome side wall 280-4, dome transition portion 280-5, and dome crown 280-6.

Dome deflection portion 130-3 has a curved S-shaped configuration in cross-section having a curved extent 240.

Dome side wall 280-4 has a tapered cross-section profile, i.e., the wall thickness increases in a direction from the dome deflection portion 130-3 to dome transition portion 280-5, and has a straight extent 282 at an off-vertical angle 284 of 17±3 degrees relative to the vertical axis at the juncture of dome transition portion 280-5 and dome crown 280-6. While dome side wall 280-4 is similar in cross-section profile to dome side wall 130-4 of diaphragm 130 or dome side wall 260-4 of diaphragm 260, it is noted that the amount of taper of dome side wall 280-4 is less than either of dome side wall 130-4 of diaphragm 130 or dome side wall 260-4 of diaphragm 260. As such, dome side wall 260-4 has a thinner cross-section profile than dome side wall 130-4 of diaphragm 130 or dome side wall 260-4 of diaphragm 260.

Dome transition portion 280-5 has substantially uniform thickness in cross-section, having a straight extent 286 at an off-vertical angle 288 of 77±3 degrees.

Dome crown 280-6 has substantially uniform thickness in cross-section, having a straight extent 290 and is horizontal, i.e., with an off-vertical angle of 90 degrees.

The hardness of the elastomeric material constituting diaphragm 280 is 50±3 durometer. This configuration was found to achieve the pressure versus deliverable fluid curve 236 of FIG. 28, with a backpressure variation range of plus or minus five percent.

Thus, each of diaphragm 130, diaphragm 260, and diaphragm 280 was able to achieve the pressure versus deliverable fluid curve 236 of FIG. 28. However, in comparison to diaphragm 130, diaphragm 280 was able to do so using a higher durometer elastomeric material by reducing the amount of wall thickness of dome side wall 280-4. Accordingly, the configuration of diaphragm 280 retains the manufacturing simplicity of the design of diaphragm 130, while permitting the use of a higher durometer material than that of diaphragm 130.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fluidic dispensing device, comprising:

a body including a base wall having an exterior base surface, and an interior perimetrical wall that extends from the base wall to define a chamber, the interior perimetrical wall having a perimetrical end surface, the body having an exterior wall extending away from the base wall, the exterior wall having a chip mounting surface defining a first plane, the base wall being oriented along a second plane, the first plane being orthogonal to the second plane;

an ejection chip mounted to the chip mounting surface of the body;

a diaphragm engaged with the perimetrical end surface of the chamber to define a fluid reservoir; and a lid attached to the body, with the diaphragm interposed between the lid and the body, the body and the lid defining a split at a juncture of the lid and the body.

2. The fluidic dispensing device of claim 1, wherein a ratio of a distance A from the exterior base surface of the base wall of the body to a center of the ejection chip and a distance C from the exterior base surface of the base wall of the body to a top of the exterior wall of the body at the location of the split is in a range of 20 percent to 80 percent, and the distance A is less than the distance C.

3. The fluidic dispensing device of claim 2, wherein a ratio of the distance A and a distance B from the exterior base surface of the base wall of the body to the perimetrical end surface of the interior perimetrical wall of the chamber of the body is in a range of 20 percent to 80 percent, and the distance A is less than the distance B.

4. The fluidic dispensing device of claim 2, wherein the diaphragm has a dome portion and the lid has a lid portion that accommodates the dome portion, and wherein a ratio of the distance C and a distance D from the exterior base surface of the base wall of the body to a top of the lid portion of the lid that accommodates the dome portion of the diaphragm is in a range of 40 percent to 95 percent, and the distance C is less than the distance D.

5. The fluidic dispensing device of claim 2, wherein the diaphragm has a dome portion and the lid has a lid portion that accommodates the dome portion, and wherein a ratio of a distance B from the exterior base surface of the base wall of the body to the perimetrical end surface of the interior perimetrical wall of the chamber of the body and a distance D from the exterior base surface of the base wall of the body to a top of the lid portion of the lid that accommodates the dome portion of the diaphragm is in a range of 40 percent to 95 percent, and the distance A is less than the distance B, and the distance B is less than the distance D.

6. The fluidic dispensing device of claim 2, wherein the diaphragm has a dome portion and the lid has a lid portion that accommodates the dome portion, and wherein:

a ratio of the distance A and a distance B from the exterior base surface of the base wall of the body to the perimetrical end surface of the interior perimetrical wall of the chamber of the body is in a range of 20 percent to 80 percent, and the distance A is less than the distance B; and a ratio of the distance C and a distance D from the exterior base surface of the base wall of the body to a top of the lid portion of the lid that accommodates the dome portion of the diaphragm is in a range of 40 percent to 95 percent, and the distance C is less than the distance D.

7. The fluidic dispensing device of claim 2, wherein:

a ratio of the distance A and a distance B from the exterior base surface of the base wall of the body to the perimetrical end surface of the interior perimetrical wall of the chamber of the body is in a range of 20 percent to 80 percent, and the distance A is less than the distance B; and a ratio of the distance B from the exterior base surface of the base wall of the body to the perimetrical end surface of the interior perimetrical wall of the chamber of the body and a distance D from the exterior base surface of the base wall of the body to a top of the lid portion of the lid that accommodates the dome portion of the diaphragm is in a range of 40 percent to 95 percent, and the distance B is less than the distance D.

8. The fluidic dispensing device of claim 2, wherein the diaphragm has a dome portion and the lid has a lid portion that accommodates the dome portion, and wherein:

a ratio of the distance C and a distance D from the exterior base surface of the base wall of the body to a top of the lid portion of the lid that accommodates the dome portion of the diaphragm is in a range of 40 percent to 95 percent, and the distance C is less than the distance D; and a ratio of the distance B from the exterior base surface of the base wall of the body to the perimetrical end surface of the interior perimetrical wall of the chamber of the body and a distance D from the exterior base surface of the base wall of the body to a top of the lid portion of the lid that accommodates the dome portion of the diaphragm is in a range of 40 percent to 95 percent, and the distance A is less than the distance B, and the distance B is less than the distance D.

9. The fluidic dispensing device of claim 2, wherein the diaphragm has a dome portion and the lid has a lid portion that accommodates the dome portion, and wherein:

a ratio of the distance A and a distance B from the exterior base surface of the base wall of the body to the perimetrical end surface of the interior perimetrical wall of the chamber of the body is in a range of 20 percent to 80 percent, and the distance A is less than the distance B;

a ratio of the distance C and a distance D from the exterior base surface of the base wall of the body to a top of the lid portion of the lid that accommodates the dome portion of the diaphragm is in a range of 40 percent to 95 percent, and the distance C is less than the distance D; and a ratio of the distance B from the exterior base surface of the base wall of the body to the perimetrical end surface of the interior perimetrical wall of the chamber of the body and a distance D from the exterior base surface of the base wall of the body to a top of the lid portion of the lid that accommodates the dome portion of the diaphragm is in a range of 40 percent to 95 percent, and the distance B is less than the distance D.

10. The fluidic dispensing device of claim 1, wherein the ejection chip has a fluid ejection direction and the diaphragm has a deflection axis, and wherein the deflection axis of the diaphragm is substantially perpendicular to the fluid ejection direction.

11. The fluidic dispensing device of claim 1, wherein the diaphragm has a deflection axis and a dome portion having a dome crown, and wherein during a displacement of the dome portion along the deflection axis the dome crown becomes concave.

12. The fluidic dispensing device of claim 1, wherein the diaphragm has a deflection axis and a dome portion having a dome crown, and the dome crown is movable along the deflection axis.

13. The fluidic dispensing device of claim 1, wherein the lid covers over the diaphragm to form a dome vent chamber between the lid and the diaphragm, at least one of the body and the lid having at least one vent opening in fluid communication with the dome vent chamber and with the atmosphere external to the fluidic dispensing device.

14. A fluidic dispensing device, comprising:

a body including a base wall having an exterior base surface, and an interior perimetrical wall that extends from the base wall to define a chamber, the interior perimetrical wall having a perimetrical end surface, the body having an exterior wall extending away from the base wall, the exterior wall having a chip mounting surface defining a first plane, the base wall being oriented along a second plane, the first plane being orthogonal to the second plane;

an ejection chip mounted to the chip mounting surface of the body;

a diaphragm engaged with the perimetrical end surface of the chamber to define a fluid reservoir, the diaphragm having a dome portion; and a lid attached to the body, with the diaphragm interposed between the lid and the body, the lid having a lid portion that accommodates the dome portion of the diaphragm, the body and the lid defining a split at a juncture of the lid and the body, wherein:

a ratio of a distance A from the exterior base surface of the base wall of the body to a center of the ejection chip and a distance B from the exterior base surface of the base wall of the body to the perimetrical end surface of the interior perimetrical wall of the chamber of the body is in a range of 20 percent to 80 percent, and the distance A is less than the distance B.

15. The fluidic dispensing device of claim 14, wherein a ratio of a distance C from the exterior base surface of the base wall of the body to a top of the exterior wall of the body at the location of the split and a distance D from the exterior base surface of the base wall of the body to a top of the lid portion of the lid that accommodates the dome portion of the diaphragm is in a range of 40 percent to 95 percent, and the distance C is less than the distance D.

16. The fluidic dispensing device of claim 14, wherein a ratio of a distance B from the exterior base surface of the base wall of the body to the perimetrical end surface of the interior perimetrical wall of the chamber of the body and a distance D from the exterior base surface of the base wall of the body to a top of the lid portion of the lid that accommodates the dome portion of the diaphragm is in a range of 40 percent to 95 percent, and the distance A is less than the distance B, and the distance B is less than the distance D.

17. The fluidic dispensing device of claim 14, wherein:

a ratio of a distance C from the exterior base surface of the base wall of the body to a top of the exterior wall of the body at the location of the split and a distance D from the exterior base surface of the base wall of the body to a top of the lid portion of the lid that accommodates the dome portion of the diaphragm is in a range of 40 percent to 95 percent, and the distance C is less than the distance D; and a ratio of the distance B and the distance D is in a range of 40 percent to 95 percent, and wherein the distance A is less than the distance B, and the distance B is less than the distance D.

18. A fluidic dispensing device, comprising:

a body including a base wall having an exterior base surface, and an interior perimetrical wall that extends from the base wall to define a chamber, the interior perimetrical wall having a perimetrical end surface, the body having an exterior wall extending away from the base wall, the exterior wall having a chip mounting surface defining a first plane, the base wall being oriented along a second plane, the first plane being orthogonal to the second plane;

an ejection chip mounted to the chip mounting surface of the body;

a diaphragm engaged with the perimetrical end surface of the chamber to define a fluid reservoir, the diaphragm having a dome portion; and a lid attached to the body, with the diaphragm interposed between the lid and the body, the lid having a lid portion that accommodates the dome portion of the diaphragm, the body and the lid defining a split at a juncture of the lid and the body, wherein:

a ratio of the distance B from the exterior base surface of the base wall of the body to the perimetrical end surface of the interior perimetrical wall of the chamber of the body and a distance D from the exterior base surface of the base wall of the body to a top of the lid portion of the lid that accommodates the dome portion of the diaphragm is in a range of 40 percent to 95 percent, and the distance B is less than the distance D.

19. The fluidic dispensing device of claim 18, wherein:

a ratio of a distance C from the exterior base surface of the base wall of the body to a top of the exterior wall of the body at the location of the split and the distance D is in a range of 40 percent to 95 percent, and the distance C is less than the distance D.

20. The fluidic dispensing device of claim 18, wherein the lid covers over the diaphragm to form a dome vent chamber between the lid and the diaphragm, and each of the body and the lid having at least one vent opening in fluid communication with the dome vent chamber and with the atmosphere external to the fluidic dispensing device.

* * * * *